US011268323B2

(12) United States Patent
Mathieson

(10) Patent No.: US 11,268,323 B2
(45) Date of Patent: Mar. 8, 2022

(54) GUTTER PROTECTION AND LADDER SUPPORT APPARATUS

(71) Applicant: Thomas R. Mathieson, Louisville, CO (US)

(72) Inventor: Thomas R. Mathieson, Louisville, CO (US)

( * ) Notice: Subject to any disclaimer, the term of this patent is extended or adjusted under 35 U.S.C. 154(b) by 374 days.

(21) Appl. No.: 16/171,957

(22) Filed: Oct. 26, 2018

(65) Prior Publication Data

US 2019/0063154 A1 Feb. 28, 2019

Related U.S. Application Data

(60) Division of application No. 14/186,777, filed on Feb. 21, 2014, now Pat. No. 10,407,986, which is a continuation-in-part of application No. 12/618,618, filed on Nov. 13, 2009, now abandoned.

(60) Provisional application No. 61/114,393, filed on Nov. 13, 2008.

(51) Int. Cl.

| | |
|---|---|
| ***E04D 7/00*** | (2006.01) |
| ***E06C 7/48*** | (2006.01) |
| ***E04D 13/076*** | (2006.01) |

(52) U.S. Cl.

CPC ..... *E06C 7/486* (2013.01); *E04D 13/076* (2013.01)

(58) Field of Classification Search

CPC .... E04D 7/06; E04D 7/46; E04D 7/48; E04D 7/486; E04D 13/0725; E04D 13/0727; E04D 13/072

See application file for complete search history.

(56) References Cited

U.S. PATENT DOCUMENTS

| | | | | | |
|---|---|---|---|---|---|
| 2,271,081 | A * | 1/1942 | Layton | E04D 13/076 | 52/12 |
| 2,808,975 | A | 10/1957 | Palmquist | | |
| 3,333,803 | A * | 8/1967 | Landis | E04D 13/072 | 248/48.2 |
| 3,603,431 | A * | 9/1971 | Nameche | E06C 7/486 | 182/206 |
| 3,853,202 | A * | 12/1974 | Jarboe | E06C 7/486 | 182/108 |
| 4,143,743 | A * | 3/1979 | Larson | E06C 7/48 | 182/107 |
| 4,580,660 | A * | 4/1986 | Oling | E06C 7/48 | 182/107 |
| 4,745,657 | A * | 5/1988 | Faye | E04D 13/076 | 16/226 |

(Continued)

FOREIGN PATENT DOCUMENTS

| | | | | |
|---|---|---|---|---|
| FR | 2714931 A1 * | 7/1995 | ..... | E06C 1/34 |
| FR | 2714931 A1 | 7/1995 | | |

*Primary Examiner* — Colleen M Chavchavadze
*Assistant Examiner* — Candace L Bradford
(74) *Attorney, Agent, or Firm* — Husch Blackwell LLP

(57) ABSTRACT

A gutter protection and ladder support and safety apparatus includes a mechanism structured and arranged to be releaseably positioned in a gutter to prevent damage thereto caused by a ladder. The apparatus includes a mechanism for locking the apparatus in place to prevent lateral tipping and slippage of a ladder, a ladder supporting member operatively connected to the locking mechanism, and an adjustable ladder securing apparatus connected to the ladder supporting member and configured to releaseably secure a ladder thereto.

6 Claims, 21 Drawing Sheets

(56) References Cited

U.S. PATENT DOCUMENTS 4,765,439 A * 8/1988 Kresmery ..... E06C 7/48 182/107
4,823,912 A * 4/1989 Gould ..... E06C 7/484 182/107
5,215,163 A * 6/1993 Kent, Sr. ..... E06C 7/486 182/214
5,358,071 A * 10/1994 Stennett ..... E04D 13/12 182/107
5,388,377 A * 2/1995 Faulkner ..... E04D 13/0725 52/11
5,497,848 A 3/1996 Travis et al.
5,628,381 A * 5/1997 Markovich ..... E06C 7/486 182/107
6,209,826 B1 * 4/2001 Pratt, Jr. ..... E04D 13/0725 248/231.9
6,354,401 B2 * 3/2002 Murray ..... E06C 1/34 182/107
6,550,577 B1 * 4/2003 Allgire ..... E06C 1/34 182/107
6,722,469 B1 4/2004 Weger, Jr.
6,802,221 B2 10/2004 Hedeen et al.
6,805,221 B1 * 10/2004 Lee ..... E06C 1/34 182/107
6,837,338 B2 * 1/2005 Grover ..... E06C 7/48 182/107
6,988,335 B2 * 1/2006 Eyers ..... E04D 13/076 52/12
7,093,689 B2 * 8/2006 Poldmaa ..... E06C 1/34 182/107
7,134,525 B1 * 11/2006 Ferris ..... E06C 7/486 182/107
7,624,541 B2 * 12/2009 Gentry ..... E04D 13/076 248/48.1
2005/0082436 A1 * 4/2005 Snell ..... E04D 13/0725 248/48.2
2006/0021286 A1 * 2/2006 Saville ..... E04D 13/076 52/15
2006/0054390 A1 * 3/2006 Ray ..... E06C 7/486 182/107
2008/0010906 A1 * 1/2008 Brochu ..... E04D 13/076 52/12
2009/0266646 A1 10/2009 Hamann
2011/0114800 A1 * 5/2011 Gramling ..... E04D 13/0727 248/48.2
2011/0185641 A1 * 8/2011 Snell ..... E04D 13/076 52/12
2011/0253479 A1 * 10/2011 Gandy ..... E06C 7/486 182/107
2012/0186163 A1 * 7/2012 Walker ..... E04D 13/076 52/12
2012/0222366 A1 * 9/2012 Steinberg ..... E04D 13/076 52/12
2013/0199108 A1 * 8/2013 Lowrie, III ..... E04D 13/064 52/12
2014/0131532 A1 * 5/2014 Elmore ..... E06C 7/188 248/201
2014/0174853 A1 * 6/2014 Charlton ..... E06C 7/188 182/107

* cited by examiner 10
20
18
500'
502
502'
504
505
506
507
508
509
511
514
74
75
X

GUTTER PROTECTION AND LADDER SUPPORT APPARATUS

CROSS-REFERENCE TO RELATED APPLICATIONS

This application is a division of U.S. patent application Ser. No. 14/186,777 filed Feb. 21, 2014, which application is a continuation-in-part of U.S. patent application Ser. No. 12/618,618 filed on Nov. 13, 2009, which claims priority to U.S. Patent Application No. 61/114,393 filed on Nov. 13, 2008. The entire disclosures of U.S. patent application Ser. Nos. 14/186,777, 12/618,018 and 61/114,393 are hereby incorporated herein by reference.

FIELD OF THE INVENTION

The present invention relates in general to gutter protection devices. More particularly, the present invention relates to an apparatus designed to protect a gutter from potential damage caused by a ladder placed against it and to securely support a ladder which is placed against a gutter. Specifically, the present invention relates to a gutter protection and ladder support apparatus which supports a ladder securely against a gutter and facilitates safe transitioning from a ladder onto and off of a roof while preventing both sideways and lateral tipping of the ladder and slippage of the ladder out from under a person.

BACKGROUND OF THE INVENTION

The construction of gutters and the placement thereof against the fascia board of a building structure is well known in the art. Gutters are typically made of a thin extruded material such as aluminum or vinyl and are subject to damage when ladders are placed against them, particularly when workmen or a homeowner climbs up and down a ladder so positioned carrying heavy loads such as shingles or other roofing materials. The pressure exerted by a ladder against a gutter under these conditions typically bends or crushes it, which not only destroys the aesthetics of the guttered roofline, but also may cause clogging of the gutter. Moreover, the bent or crushed portion of the gutter may present an unstable and hazardous ladder position.

Entering and exiting the top of a ladder are considered the most dangerous maneuvers involved in ladder usage and the point where most falls occur. The danger of a ladder sliding laterally along the face of a gutter or slipping out from under a person as he or she steps off the ladder onto a roof or from a roof onto the upper rungs of the ladder is more likely to occur during these maneuvers due to the shifting an individual's weight as the entrance or exit maneuver is executed, and the danger is enhanced even further if the person is carrying a load, such as tools, shingles, or other work materials.

Considerable prior art and products in already in the marketplace exist which attempt to solve these related problems. By way of example, U.S. Pat. No. 5,358,071 issued to Stennett on Oct. 25, 1994 discloses a gutter protecting ladder attachment which fits inside a gutter channel and includes a pair of spaced apart legs and a transversely extending support rod disposed through each of the legs and a hollow rung of the ladder which are designed to provide support therefor. However, the structure of this device is fixed in dimension so that only ladders that are sufficiently narrow in width to fit between the supporting legs may be used in conjunction with it, and it is susceptible to bending and distortion through repeated use. Moreover, Stennett's apparatus is not readily adaptable to gutters of varying configurations, such as OG gutters, box gutters or half round gutters. The adaptability problem is complicated further by the availability of different gutter sizes, typically four, five or six inch depths, depending upon the application.

U.S. Pat. No. 5,497,848 issued to Travis on Mar. 12, 1996 discloses a ladder mounter gutter protector which fits over an edge of a gutter and rests against the shingles on the adjacent roof. A ladder may be secured to a flat plate or face portion of the device by cords or cables; however, the apparatus of the Travis disclosure does not address the tipping or slippage problem.

U.S. Pat. No. 6,354,401 issued to Murray on Mar. 12, 2002 discloses a U-shaped gutter saver and ladder support which fits over the gutter channel and rests against the fascia board to which the gutter is affixed. This device includes a pair of spaced-apart brackets which are positioned to prevent the ladder from sliding laterally. However, the device disclosed by Murray is positioned to rest unsecured over the gutter up against the fascia board and is susceptible to slippage while in actual use.

In view of the above, it will be apparent to those skilled in the art from this disclosure that a need exists for an improved combination gutter protection and ladder support apparatus which not only meets current safety requirements for ladder support but also which provides a readily movable apparatus for securing a ladder to a gutter while at the same time providing protection for the gutter against damage resulting from the ladder being positioned against it. This invention addresses this need in the art as well as other needs, which will become apparent to those skilled in the art from this disclosure.

SUMMARY OF THE INVENTION

In order to achieve the above mentioned objective and other objects of the present invention, a combination gutter protection, ladder support and safety apparatus is provided which is readily adjustable to fit gutters of different sizes and configurations and may be locked in place in a gutter during use. The apparatus of the instant invention includes means for securing the rungs of a ladder thereto to prevent tipping and slippage of the ladder as a user ascends or descends thereon, and the apparatus may be installed on a gutter and left in place on a semi-permanent basis, by way of example, over the course of a major roofing repair or total re-roofing job, or it may be rapidly installed and removed by a homeowner for routine maintenance or by an inspector or an adjuster who requires access to a roof for relative short period of time for inspection, taking photographs and/developing cost estimates. These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
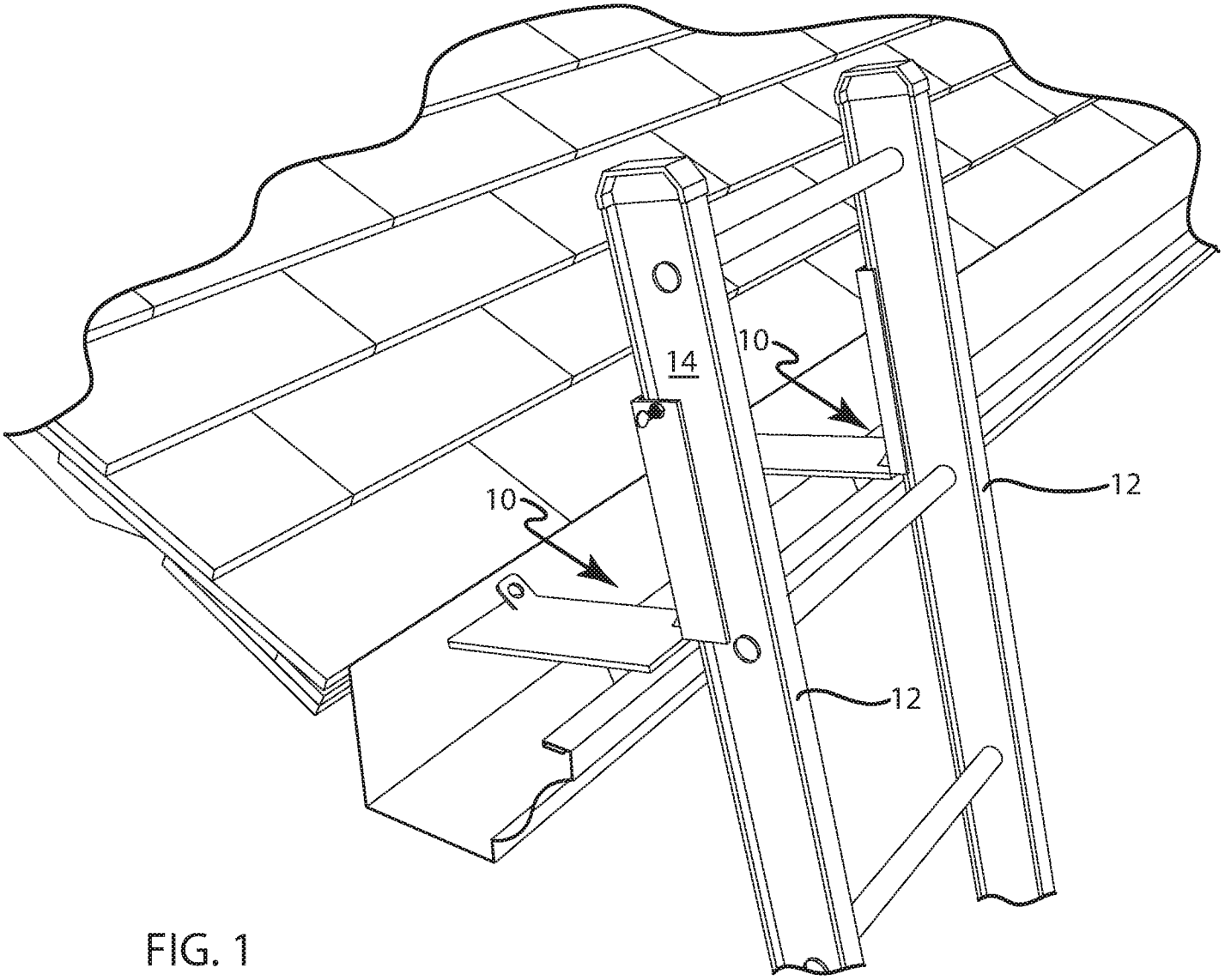
FIG. 1 is a side perspective view of the gutter protection and ladder support apparatus according to an embodiment of the present invention.

Referring initially to FIG. 1, a gutter protection and ladder support apparatus 10 is illustrated in accordance with an embodiment of the present invention. By way of illustration and not of limitation, a pair of apparatus 10 is initially positioned in a gutter spaced apart at a distance that allows each to receive a ladder rail 12 of a ladder 14. In the embodiment shown, portions of a house and gutter system are cut away to more clearly illustrate the apparatus of the present invention as installed and ready for use.

Figure 2A:
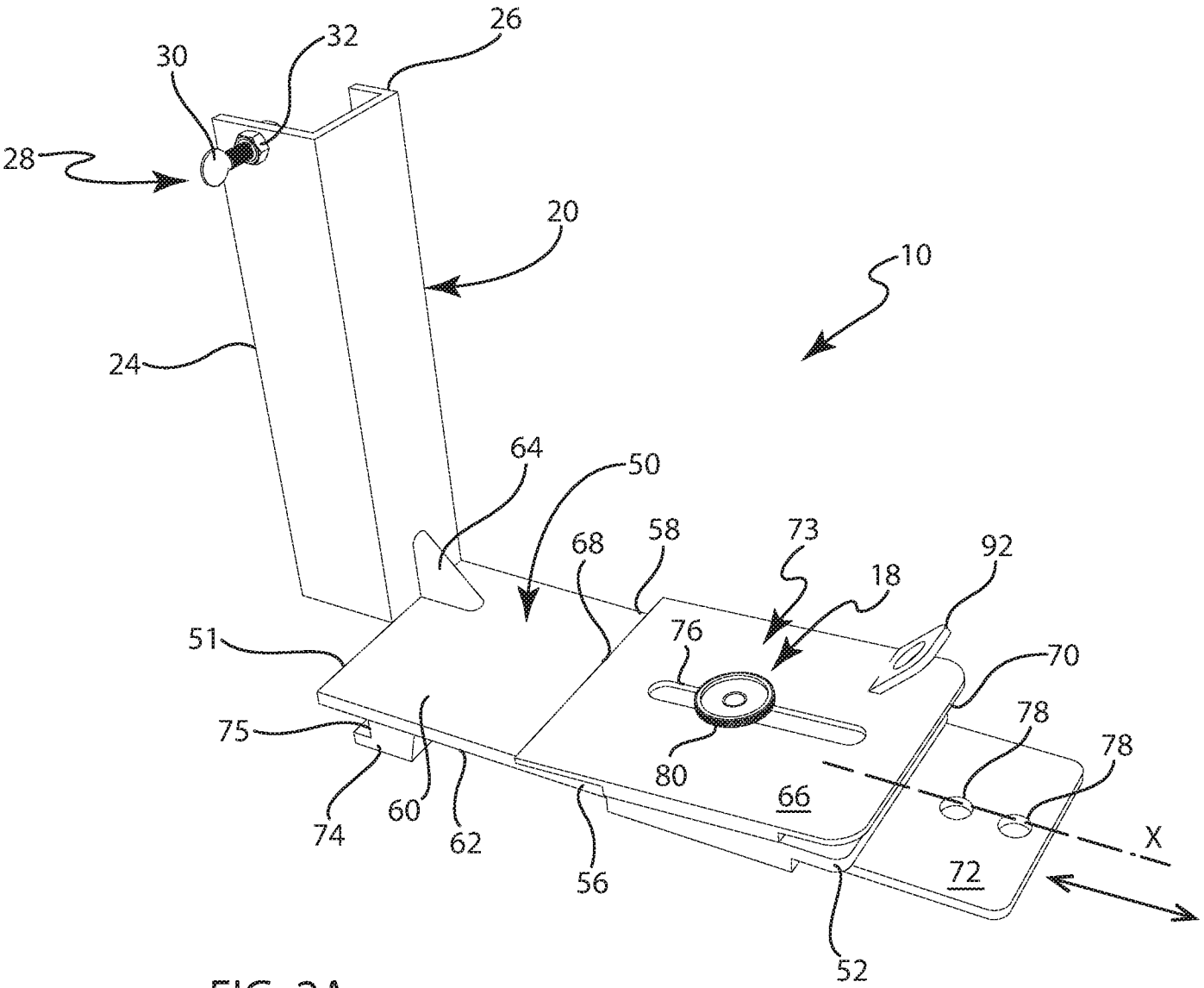
FIGS. 2(*a*)-(*c*) are side perspective views of a gutter protection and ladder support apparatus according to an embodiment of the present invention.
Figure 2B:
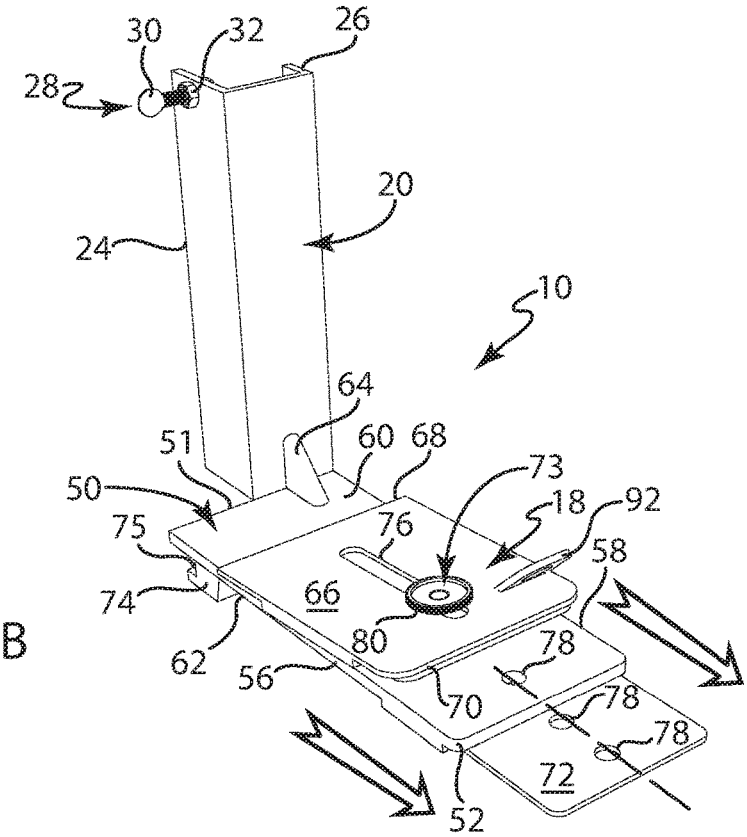
Figure 2C:
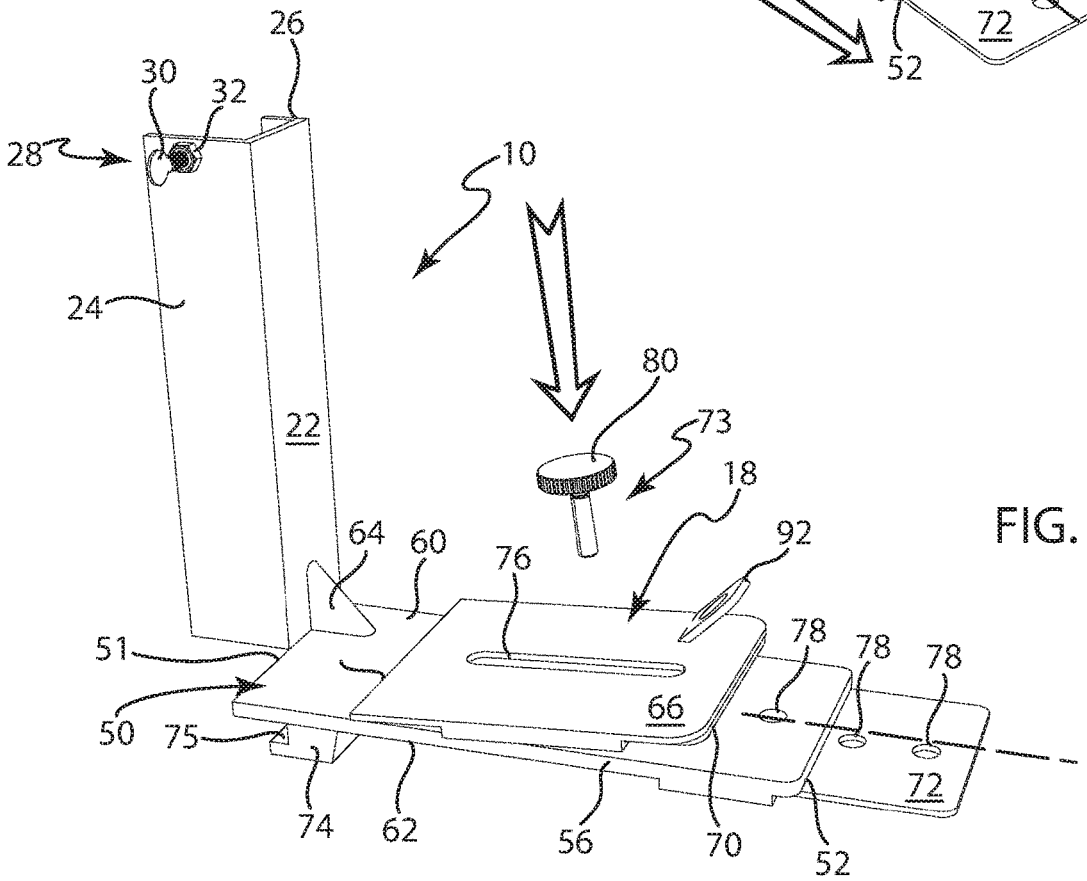
Figure 3:
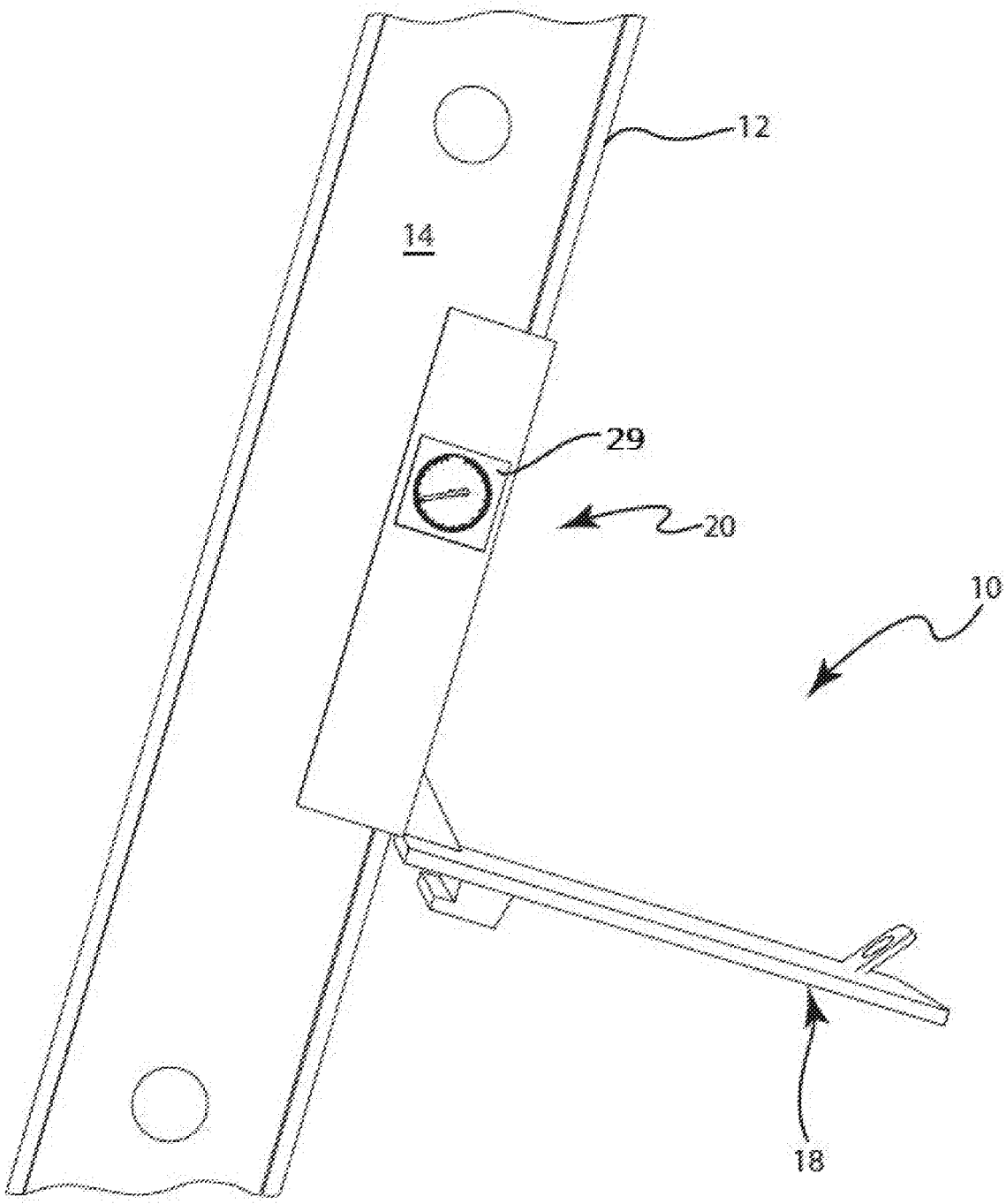
FIG. 3 is a side view of an element of the apparatus of FIG. 1 according to an embodiment of the present invention.

As shown in FIG. 1 and depicted in greater detail in FIGS. 2(*a*) and 2(*b*), the gutter protection and ladder support apparatus 10 includes a first member 18 structured and arranged to be releaseably positioned in a gutter and a second member 20 operatively connected to the first member and structured and arranged to support a ladder. In the embodiment shown, member 20 is in the form of a generally C-shaped or L-shaped channel member 20 secured in a fixed position to member 18, for example, by forming or welding, and is angled to position a ladder at an angle with respect to the ground or a supporting surface preferred by industry standards, for example, an angle of approximately 75.5° as recommended by OSHA. The channel member 20 includes a first side 22 upon which the ladder rail 14 rests and a pair of second side members 24, 26 secured to side 22 and extending generally orthogonally outwardly therefrom and cooperating therewith form the channel for receiving and securing the ladder rail. When the ladder rails 12 are positioned in each of the respective second members 20, the sides 22, 24, and 26 cooperate with one another and with the first member 18 to prevent lateral tipping of the ladder. As shown in FIG. 3, a protractor or angle indicator gauge 29 may be affixed to apparatus 10 so that a user of the ladder 14 can be assured that it is positioned at a safe angle. Thus, the present invention advantageously provides a gutter protection and ladder support apparatus 10 equipped with a quick and reliable reference for positioning a ladder at a preferred angle for a workman or homeowner to safely ascend or descend the ladder, especially when carrying a load.

Figure 4B:
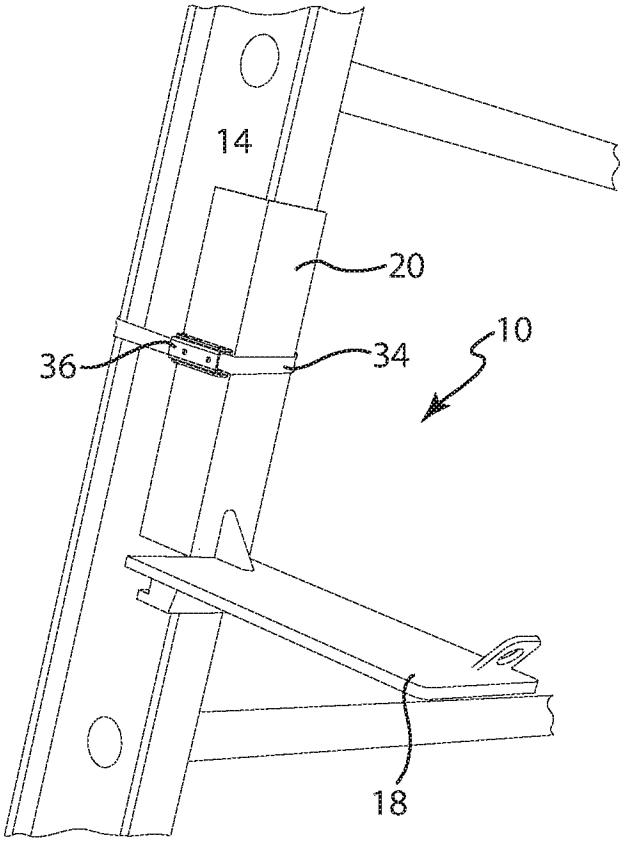
FIGS. 4(*a*)-(*b*) are side perspective views of the fastening mechanism of the apparatus of the present invention engaging a ladder in accordance with an embodiment.
Figure 4A:
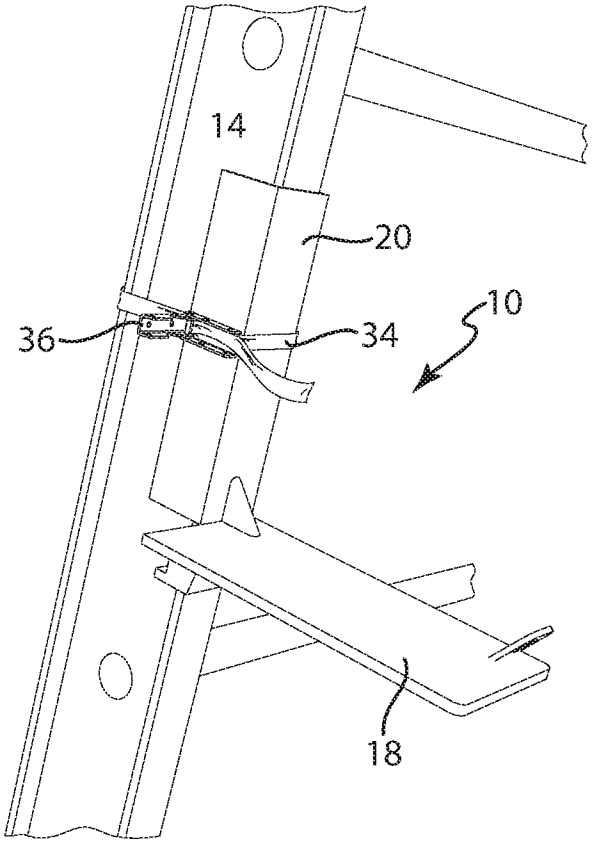
Figure 5:
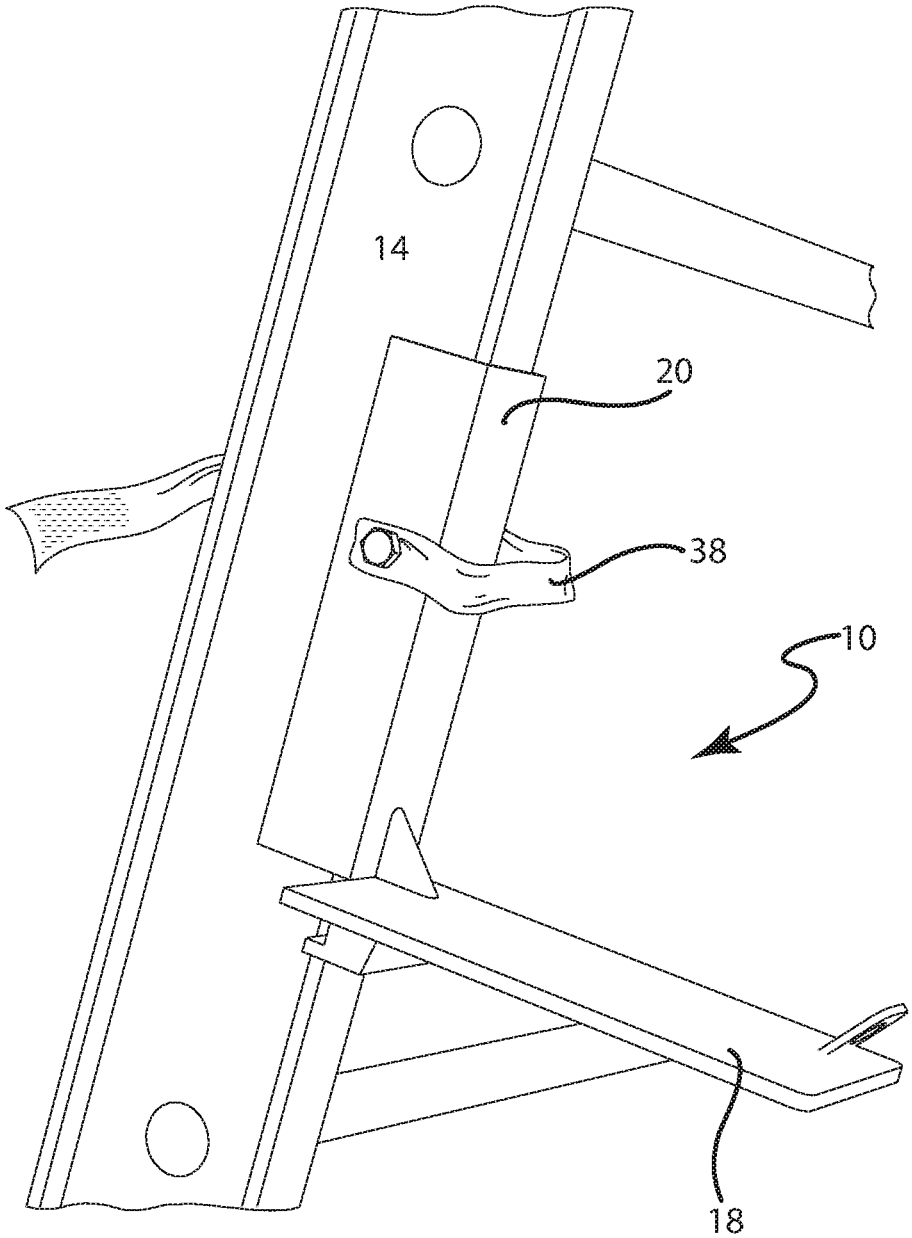
FIG. 5 is a side perspective view of the fastening mechanism of the apparatus of the present invention engaging a ladder in accordance with another embodiment.

Referring again to FIGS. 2(*a*), (*b*) and (*c*), an adjustable securing apparatus for releaseably fastening the ladder 14 to the second member 20 is shown generally at 28. In the embodiment of FIG. 2, the securing apparatus is in the form of a wing nut 30 which is threaded through side 24 of channel 20 and which may be tightened against the a ladder rail 14 after it is positioned in the channel. The wing nut 30 may be locked in position to prevent loosening by a lock nut 32. While a wing nut 30 is depicted by way of illustration for application as an adjustable securing apparatus in an embodiment, it is to be appreciated that other securing means may also be employed without departing from the scope of the present invention. By further example, the securing apparatus may be in the form of a banding or ratchet strap 34 shown being threaded through a ratchet or clamping mechanism 36 in FIG. 4(*a*) and illustrated in a secured, clamped position in FIG. 4(*b*). Alternatively, a Velcro™ strap 38 as shown in FIG. 5 may be used with equal efficacy for securing a ladder to the apparatus 10.

Figure 6B:
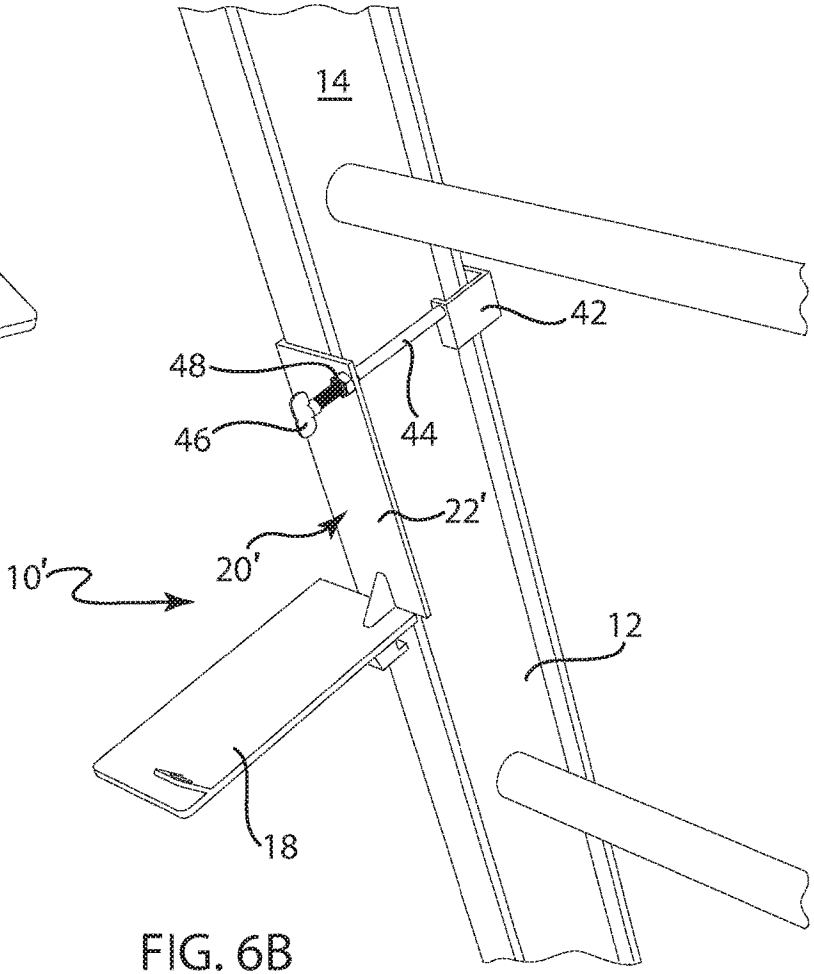
FIGS. 6(*a*)-(*b*) are side perspective views of the fastening mechanism of the apparatus of the present invention engaging a ladder in accordance with yet another embodiment.
Figure 6A:
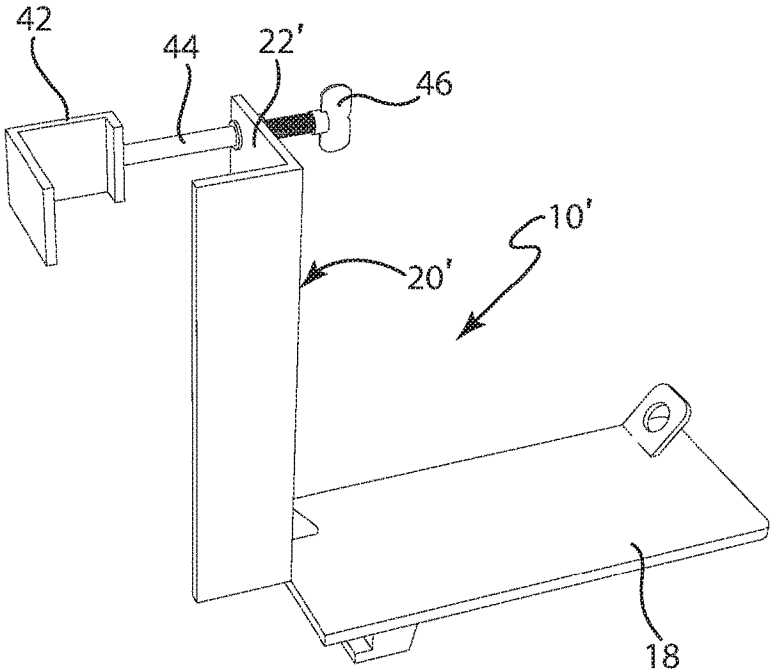

In yet another embodiment 10' of the present invention illustrated in FIGS. 6(*a*) and 6(*b*), a securing apparatus 40 is shown in the form of an adjustable channel member 42 secured to a first side 22' of second member 20', the second member in the instant embodiment, being in the form of an L-shaped member 20' secured to first member 18 as hereinabove described. The channel member 42 is adjustably secured to side 22' by a threaded rod 44 extending through a threaded aperture (not shown) formed in side 22' and may be adjusted outwardly and inwardly therefrom by means of handle 46 to accommodate ladder rails 12 of various dimensions. Once the channel 42 is tightened up against a ladder rail, it may be locked in place by a lock nut 48 to prevent loosening thereof while the ladder is in use.

Referring again to FIGS. 2(*a*), (*b*) and (*c*) the various elements and operation of first member 18 in accordance with an embodiment are discussed in greater detail. Since gutters come in different sizes and configurations, first member 18 is configured for facilitating adjustment thereof to adapt to different sized gutters and may be releaseably positioned and locked in place in a gutter regardless of the gutter's size or configuration. In the instant embodiment, first member 18 includes a plurality of juxtaposed plates slideably positioned adjacent one another and adapted to be releaseably positioned and locked in place in a gutter. More specifically, first member 18 includes a first substantially rectangular shaped plate 50 extending along a longitudinal axis x-x and having a first or proximal end 51 formed integrally with or connected to second member 22 as hereinabove described, a second or distal end 52, a pair of oppositely disposed side portions 56, 58 positioned intermediate the ends, the ends and side portions cooperating with one another to define an upper face 60 and a lower face 62 therebetween. A gusset plate 64 interconnecting member 22 and plate 50 provides additional support for the structure.

The first member 18 further includes a second plate member 66 of generally the same configuration as the first plate member, the second plate member having first and second ends 68, 70 being spaced closer together along the longitudinal axis x-x than the first and second ends of the first plate member, the second plate member being movably positioned on the upper face portion of the first plate member. A third plate member 72 of generally the same configuration as the first and second plate members is movably positioned on the lower face portion 62 of the first plate member; the first, second and third plate members being releaseably secured to one another in a preselected position by a lock mechanism shown generally at 73.

The lock mechanism 73 comprises a bracket member 74 secured to the bottom face of the first plate 50 and having an elongate channel 75 structured and arranged to engage a lip of a gutter (not shown), an elongate slot 76 formed in the second plate member extending in a direction substantially parallel with the longitudinal axis x-x, a plurality of spaced apart apertures 78 formed in each of the first and third plate members along the longitudinal axis, the plurality of apertures being substantially selectively alignable with one another and with the slot, and a fastener 80 adapted to be securably positioned in the slot and one of the plurality of apertures 78 formed in each of the first and third plate members, whereby the gutter protection and ladder support apparatus 10 is locked into position in a gutter. In the embodiment of FIG. 2, the fastener is in the form of a threaded fastener having a knurled knob affixed to an end thereof to facilitate operation thereof, each of the apertures 78 being threaded to receive the threaded fastener 80 therein.

Figure 7A:
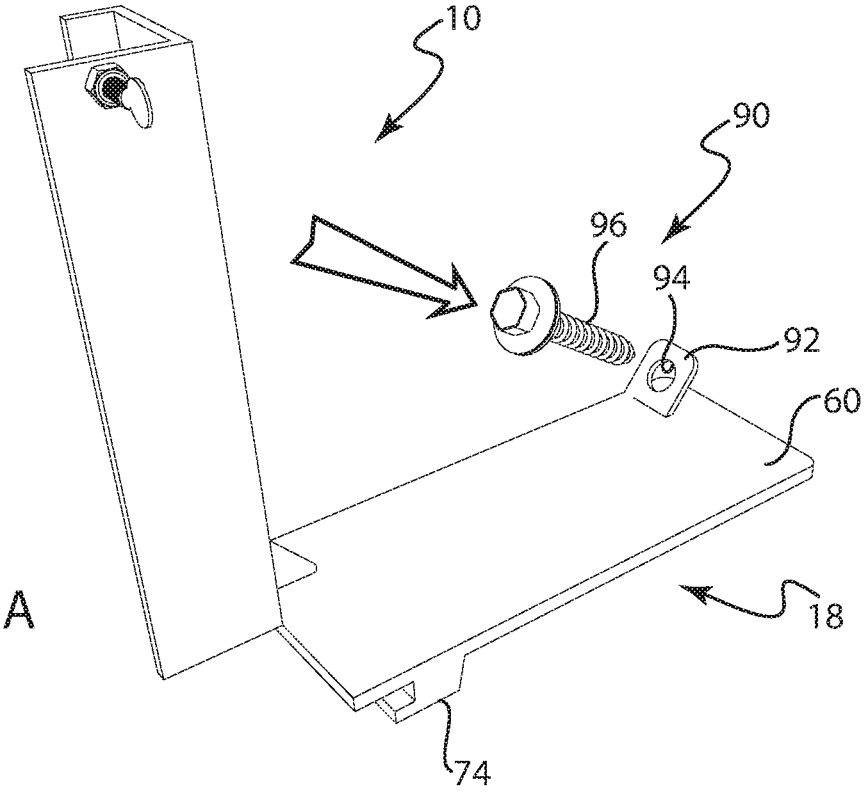
FIGS. 7(*a*)-(*b*) are side perspective views of a securing mechanism of the apparatus of the present invention in accordance with an embodiment.
Figure 7B:
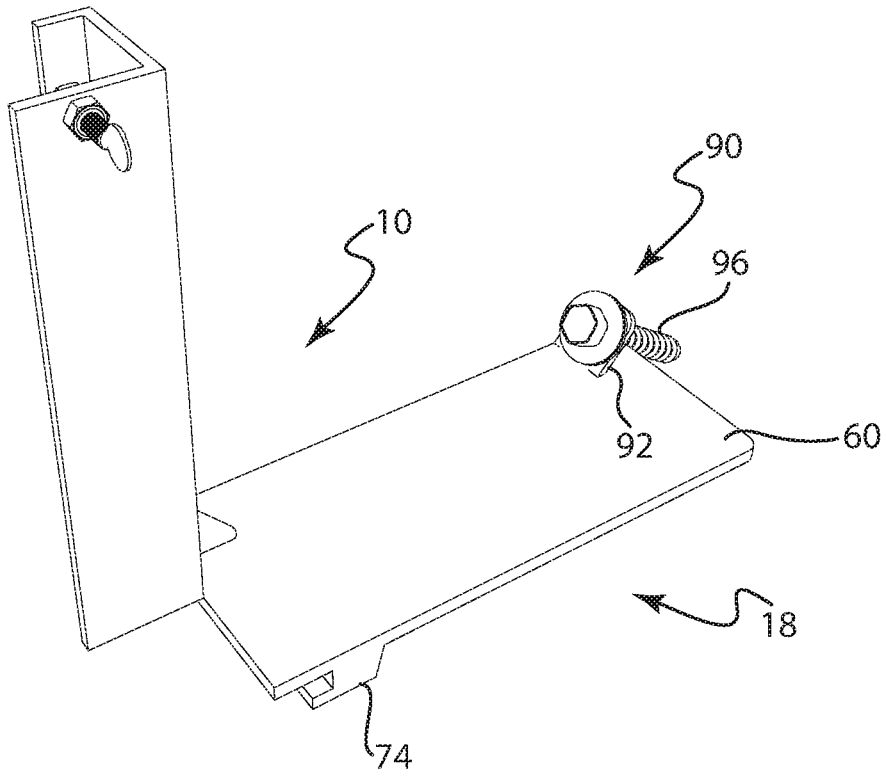

As shown in FIG. 2 and illustrated in greater detail in FIGS. 7(*a*) and 7(*b*), the gutter protection and ladder support apparatus 10 further includes a mechanism 90 for securing the apparatus to an inner surface of a gutter. The securing mechanism 90 includes a flange member 92 secured at an acute angle to the upper face 60 of member 18 and having a threaded aperture 94 formed therein. A threaded fastener, by way of example and not of limitation, a hex-head bolt 96, is adapted to be threaded into aperture 94 to engage an inner surface of a gutter, thus cooperating with bracket 74 to releaseably lock the apparatus in place in the gutter.

Figure 8B:
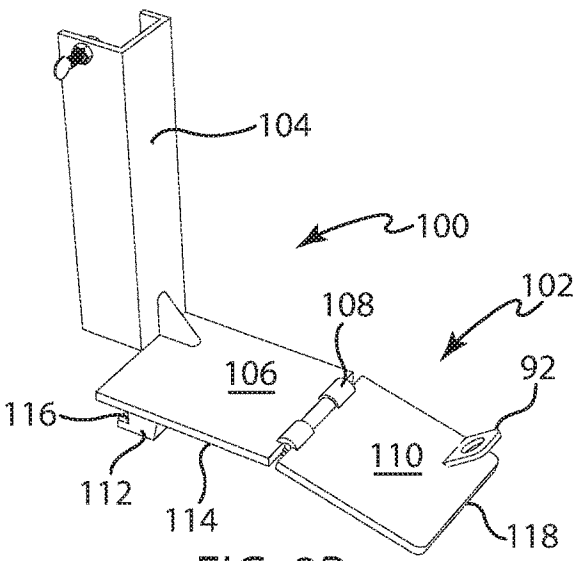
FIGS. 8(*a*)-(*c*) are side perspective views of a securing mechanism of the apparatus of the present invention in accordance with another embodiment.
Figure 8C:
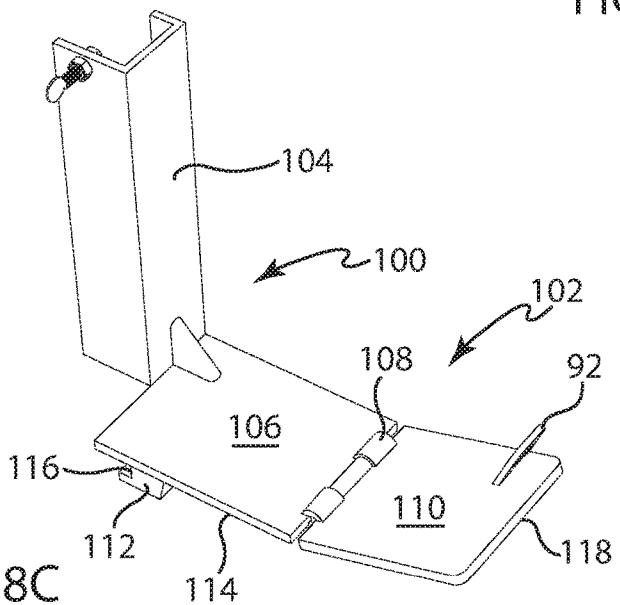
Figure 8A:
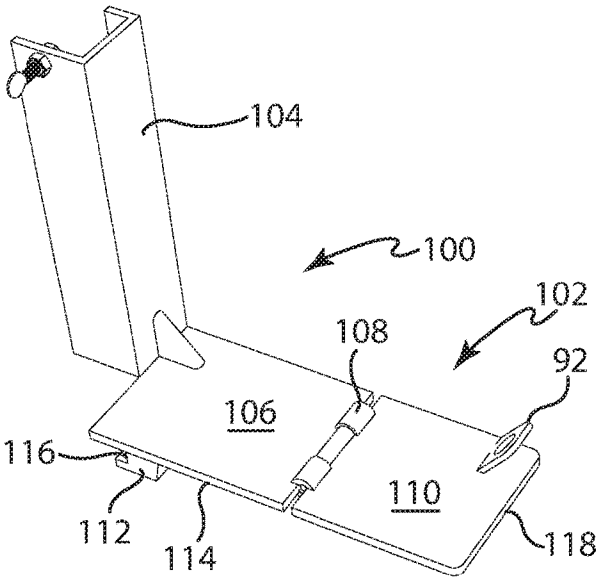

In another embodiment of the gutter protection and ladder support apparatus 100, illustrated in FIGS. 8(*a*), (*b*) and (*c*), the apparatus 100 includes a first member 102 structured and arranged to be releaseably positioned in a gutter and a second member 104 operatively connected to the first member and structured and arranged to support a ladder, as hereinabove described with respect to the embodiment of FIG. 2. However, in the embodiment shown, first member 102 comprises a hinged plate having a first plate 106 joined by a hinge 108 to a second plate 110, a bracket member 112 secured to a bottom face 114 of the first plate 106 and having an elongate channel 116 structured and arranged to engage a lip of a gutter (not shown). In operation, by pulling up on the hinge 108, the apparatus 100 is fitted into the gutter channel and positioned diagonally therein having an edge 118 abutting the bottom corner of the gutter adjacent the supporting fascia board and the elongate channel 116 extending around and engaging with the top lip of the gutter. By pushing down on the hinge 108 flexing it in a downwardly direction, the apparatus is forced into locked engagement with the lip and bottom corner of the gutter, thereby securing it in position during use.

Figure 9B:
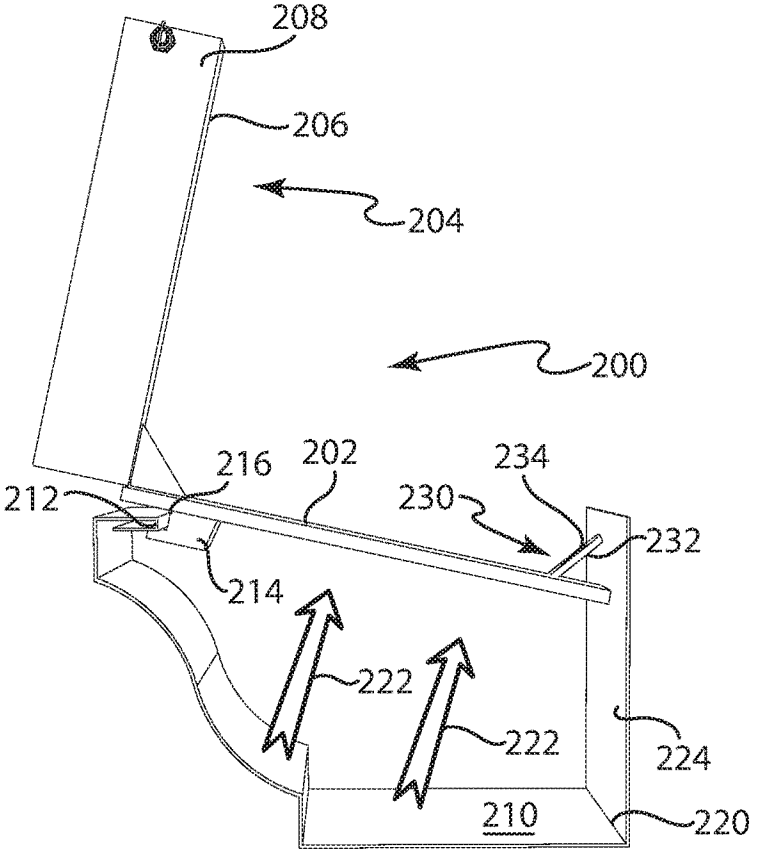
FIGS. 9(*a*)-(*b*) are side perspective views of a securing mechanism of the apparatus of the present invention in accordance with still another embodiment.
Figure 9A:
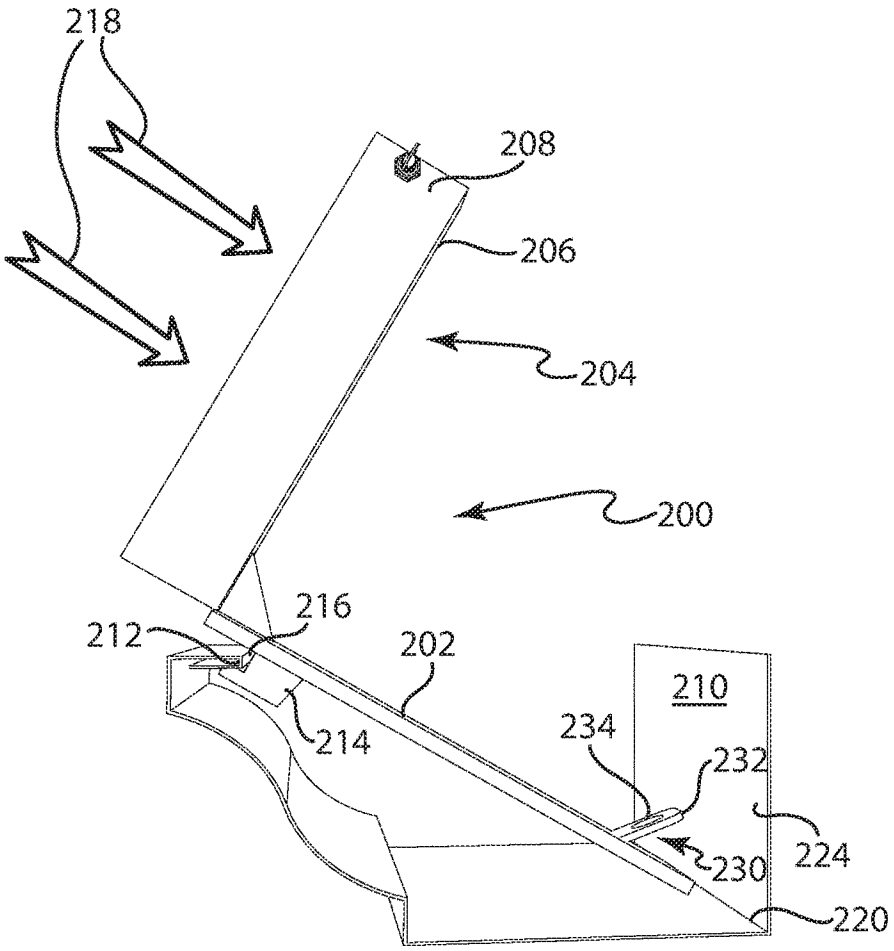

FIGS. 9(*a*) and (*b*) illustrate yet another embodiment 200 of the gutter protection and ladder support apparatus of the instant invention in which all of the elements thereof are in a fixed relationship with respect to one another. As generally described above with respect to the embodiment of FIG. 2, apparatus 200 includes a first member 202 structured and arranged to be releaseably positioned in a gutter and a second member 204 operatively connected to the first member and structured and arranged to support a ladder. Member 204 is in the form of a generally C-shaped or L-shaped channel member 204 secured in a fixed position to member 202, for example, by forming or welding, and is angled to position a ladder at an angle with respect to the ground or a supporting surface preferred by industry standards. The channel member 204 includes a first side 206 upon which a ladder rail rests and a pair of second side members 208 secured to side 206 and extending generally orthogonally outwardly therefrom and cooperating therewith form the channel for receiving and securing the ladder rail, the sides 206 and 208 cooperating with one another and with the first member 202 to prevent lateral tipping and slippage of the ladder.

The first member 202 is in the form of a generally rectangular shaped plate that extends diagonally from the bottom of a gutter 210 adjacent the facie board (not shown) to the top lip 212 of the gutter. The plate includes a lip engaging bracket 214 which includes a lip-engaging portion 216 sized and configured to fit over the gutter lip 212, as hereinabove described with respect to earlier embodiments if the invention. Referring to FIG. 9(*a*), in operation, the lip engaging portion 216 is first inserted under the gutter lip 212 by inserting the first member 202 into the gutter in the general direction of arrows 218 so that the first member extends diagonally from a bottom corner 220 of the gutter upwardly toward the lip. The entire apparatus 200 is then pulled upward and rotated slightly about the lip 212 of the gutter in the direction of the arrows 222 in FIG. 9(*b*), thereby wedging the apparatus 200 between a wall 224 of the gutter and the lip. The gutter protection and ladder support apparatus 200 further includes a mechanism 230 for securing the apparatus to the inner surface of a gutter. As described above in greater detail with respect to the embodiment of FIG. 7, the securing mechanism includes a flange member 232 secured at an acute angle to an upper face of member 202 and having a threaded aperture 234 formed therein. A threaded fastener is adapted to be threaded into aperture 94 to engage the inner surface 224 of the gutter, thus cooperating with bracket 214 to releaseably lock the apparatus in place.

Figure 10A:
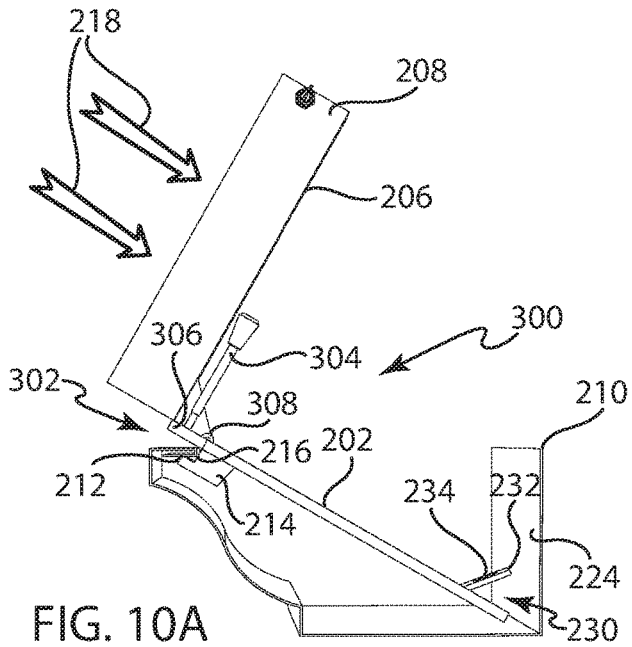
FIGS. 10(*a*)-(*c*) are side perspective views of a securing mechanism of the apparatus of the present invention in accordance with yet another embodiment.
Figure 10B:
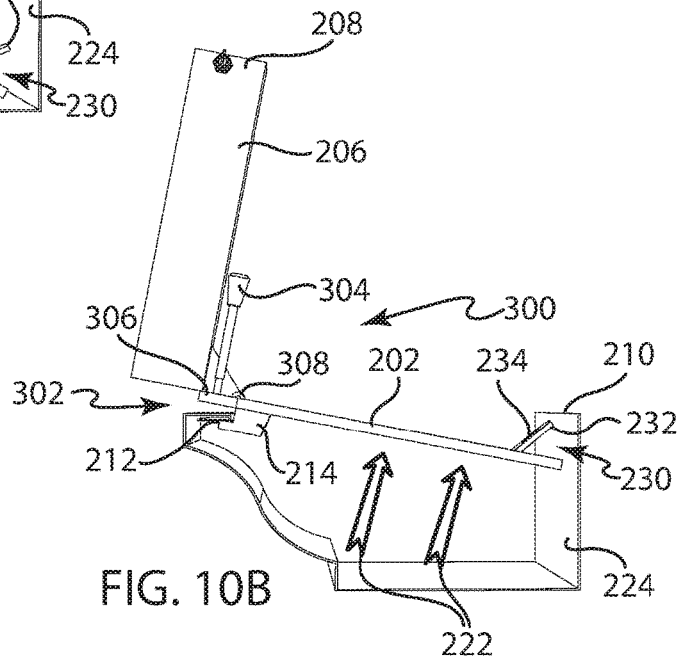
Figure 10C:
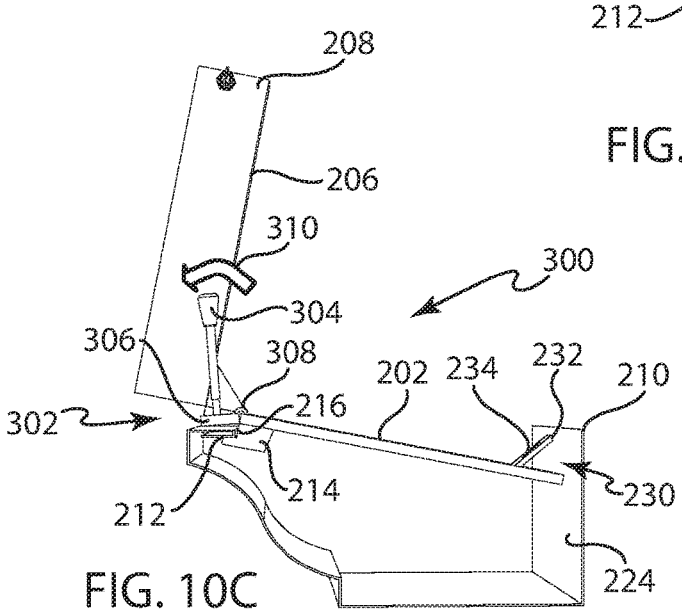

FIGS. 10(*a*)-(*c*) illustrate another embodiment of the ladder apparatus 300 which is of the same construction as the embodiment of FIG. 9 with the exception of the configurations of a locking mechanism for releaseably securing the apparatus in position in a gutter. In the embodiment of FIG. 10, a locking mechanism 302 is provided which comprises a handle or lever 304 secured to a plate member 306 which is pivotally connected by hinge 308 to the first member 202. After the apparatus 300 is placed into the gutter 210, the lever 304 is pulled in the direction of the arrow 310 shown in FIG. 10(*c*), thereby wedging the apparatus 300 between the wall 224 of the gutter and the lip, the method and sequence of installation of which is described above in detail with respect to the embodiment of FIG. 9. However, in the instant embodiment of apparatus 300, in response to further movement of lever 304 in the direction of arrow 310 as shown in FIG. 10(*c*), plate member 306 rotates about hinge 308 into locking engagement with the lip 212 of the gutter 210, thus securing the apparatus in position for safe use. The gutter protection and ladder support apparatus 300 further includes the mechanism 230 for securing the apparatus to the inner surface of a gutter, as described in detail above.

Figure 11A:
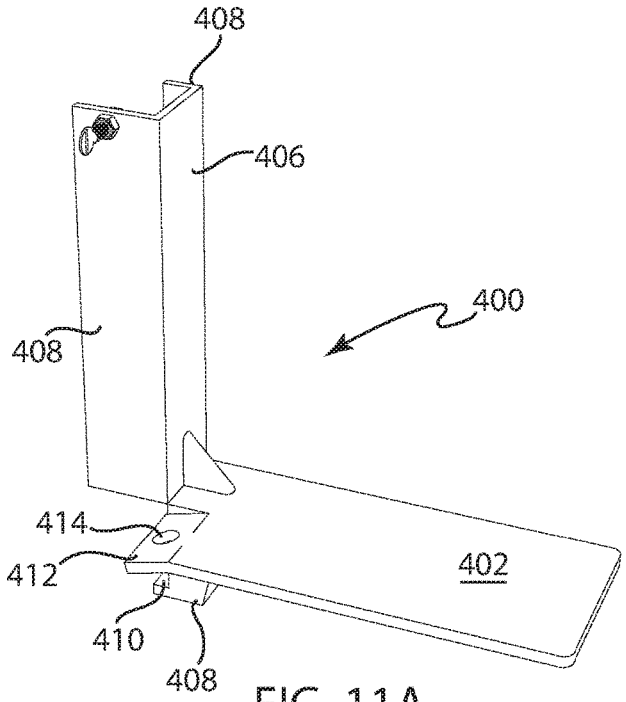
FIGS. 11(*a*)-(*c*) are side perspective views of a securing mechanism of the apparatus of the present invention in accordance with an embodiment.
Figure 11B:
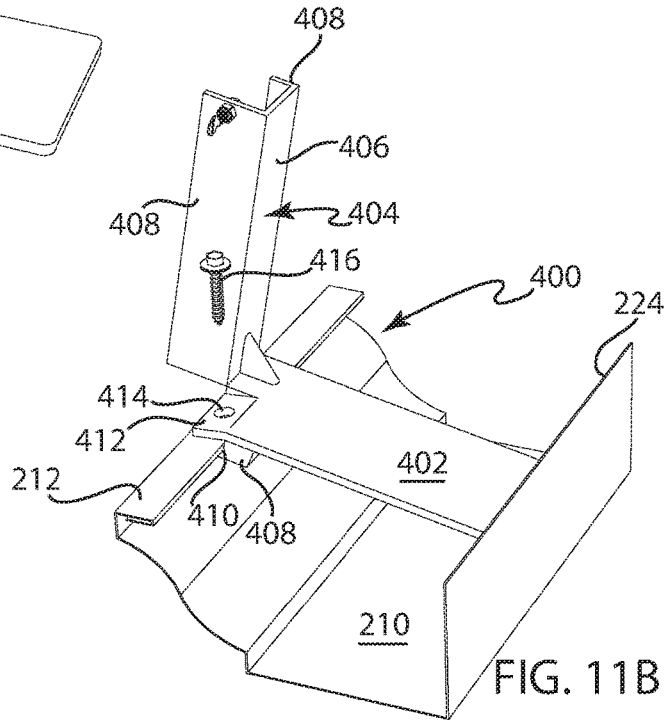
Figure 11C:
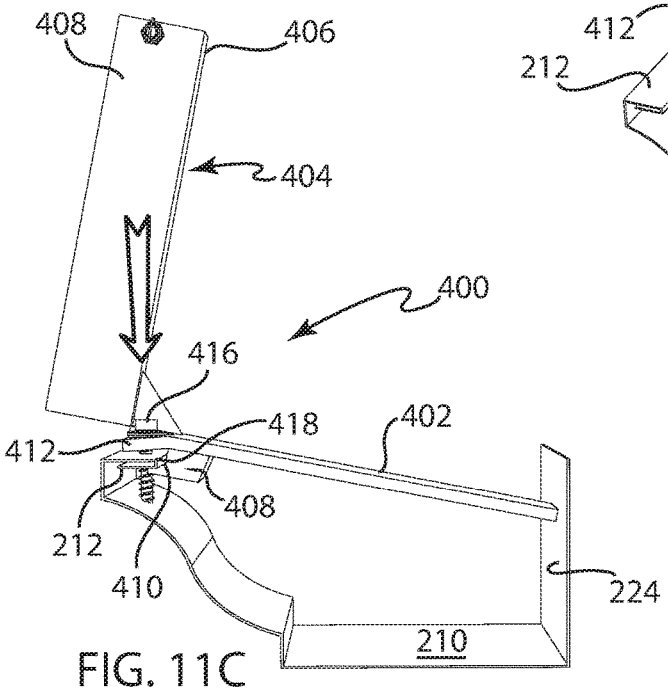
Figure 12A:
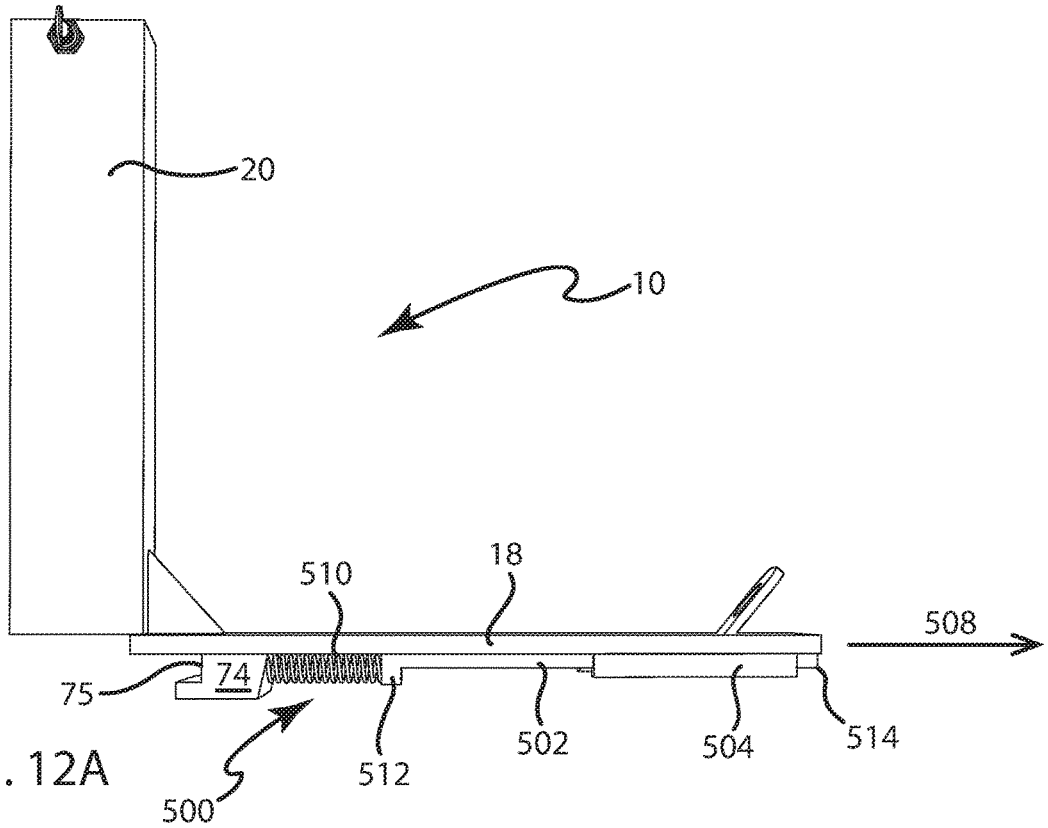
FIGS. 12(*a*)-(*d*) are side perspective views of a securing mechanism of the apparatus of the present invention in accordance with another embodiment.
Figure 12B:
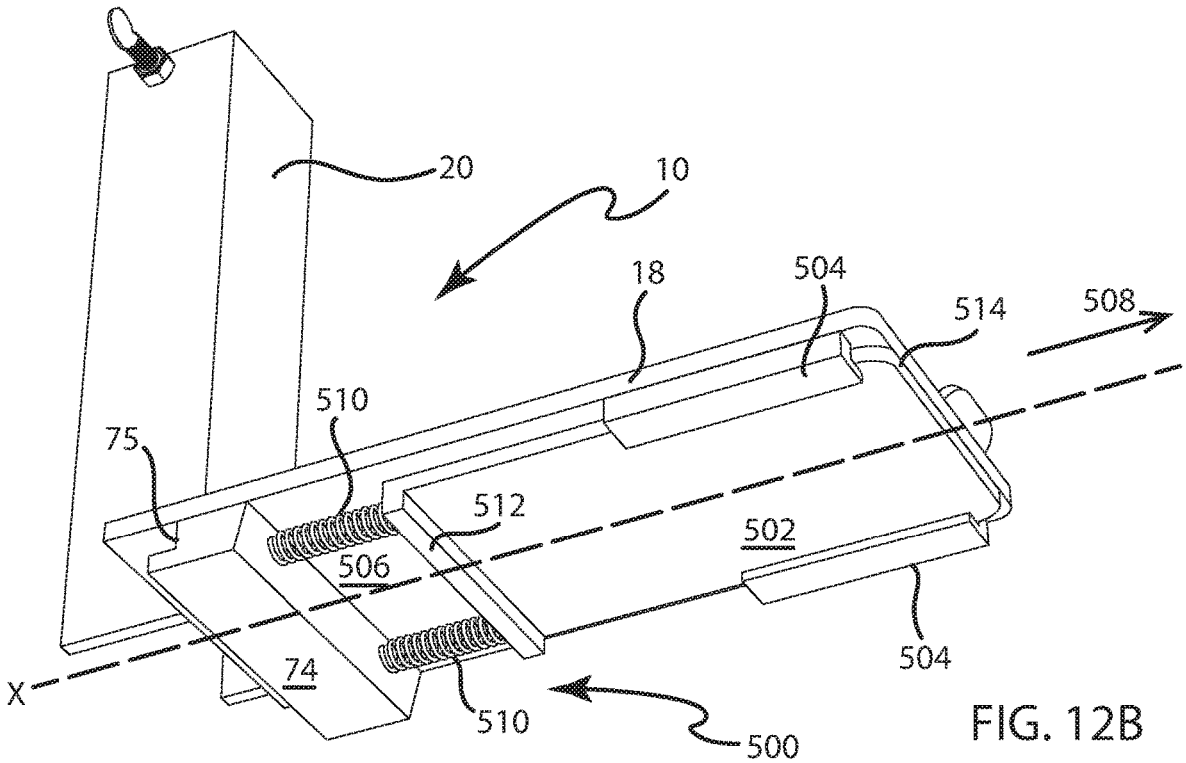
Figure 12C:
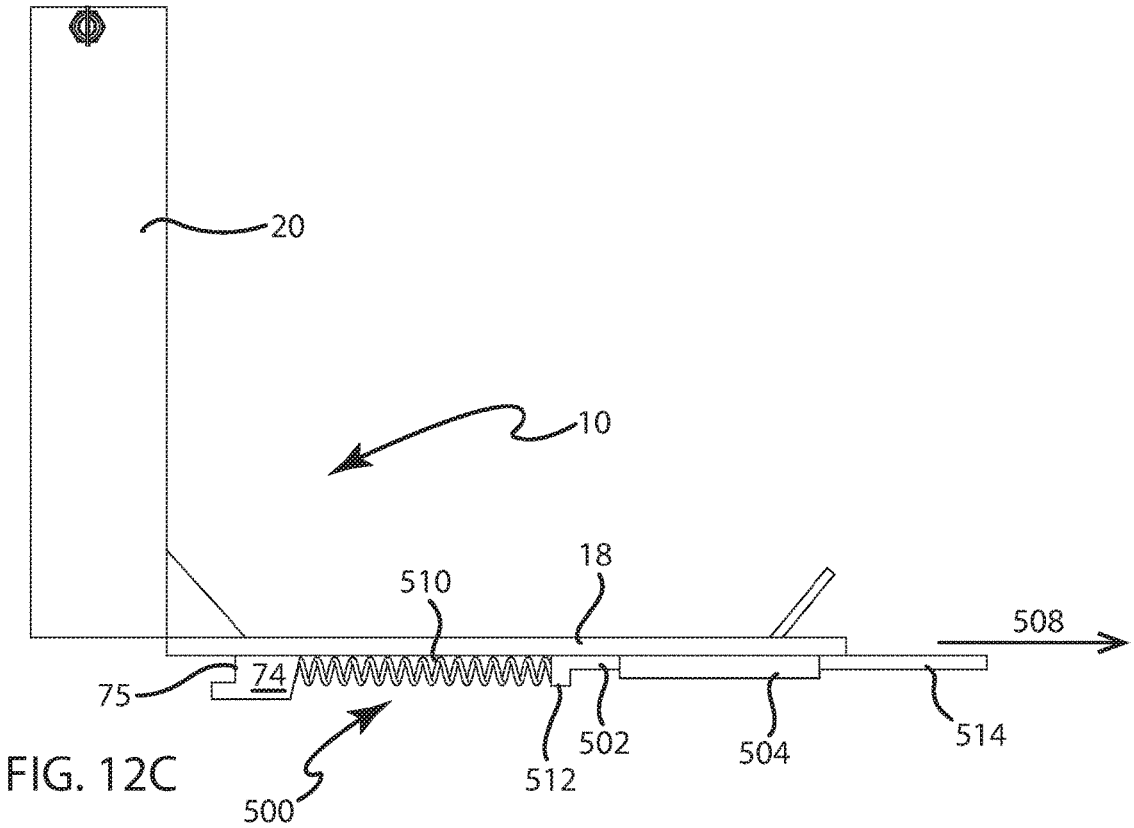
Figure 12D:
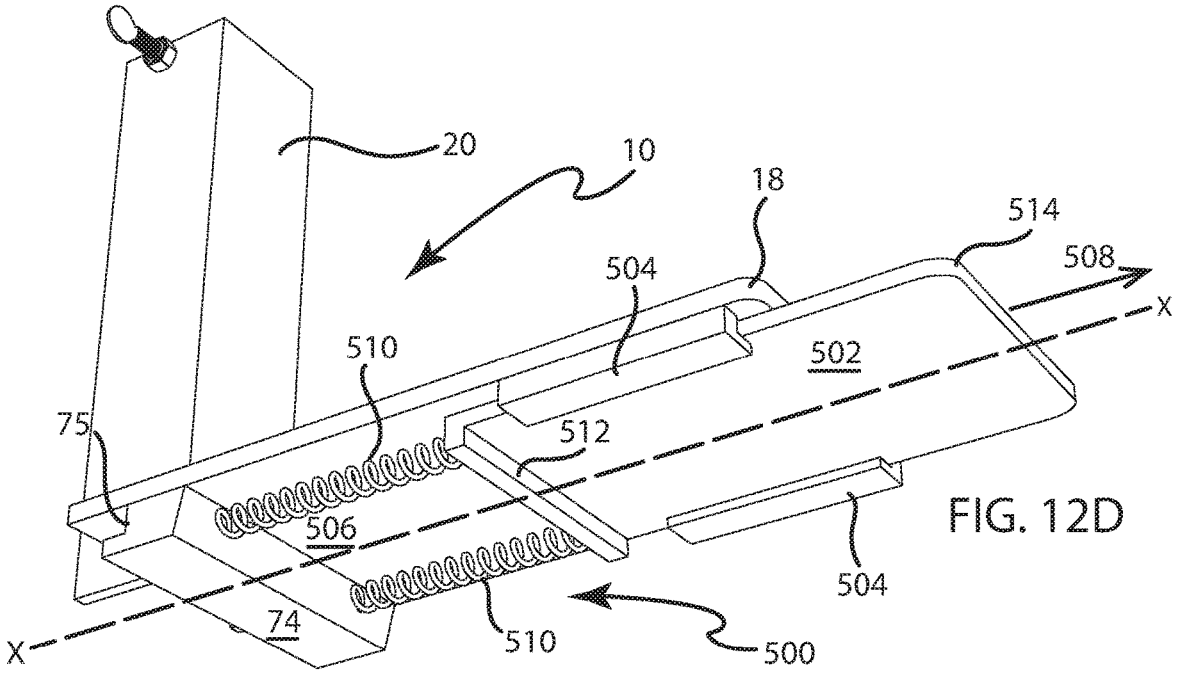

Referring now to FIGS. 11(*a*)-(*c*), yet another embodiment of the gutter protection and ladder support apparatus of the present invention is show at 400. Apparatus 400 includes 402 structured and arranged to be releaseably positioned in a gutter 210 and a second member 404 operatively connected to the first member and structured and arranged to support a ladder. Member 404 is in the form of a generally C-shaped or L-shaped channel member 404 secured in a fixed position to member 402, for example, by forming or welding, and is angled to position a ladder at an angle with respect to the ground or a supporting surface preferred by industry standards. The channel member 404 includes a first side 406 upon which a ladder rail rests and a pair of second side members 408 secured to side 406 and extending generally orthogonally outwardly therefrom and cooperating therewith form the channel for receiving and securing the ladder rail, the sides 408 cooperating with one another and with the first member 402 to prevent lateral tipping and slippage of the ladder.

The first member 402 is in the form of a generally rectangular shaped plate that extends diagonally from the rear wall 224 of the gutter 210 adjacent the facie board (not shown) to the top lip 212 of the gutter. The plate includes a lip engaging bracket 408 which includes a lip-engaging portion 410 sized and configured to fit over the gutter lip 212, as hereinabove described with respect to earlier embodiments if the invention. The plate 402 further includes an offset portion 412 which is integrally formed with plate member 402 and positioned or bent in a downward direction from a plane of the plate to selectively locate the apparatus 400 relative to the gutter channel and to set the angle of the ladder at an acceptable and safe angle. The offset portion 412 further includes a threaded aperture 414 formed therein which is aligned with an aperture 418 formed in the lip of the gutter; the apertures being adapted to receive fastener 416, by way of example and not of limitation, a threaded hex-head bolt, to secure the apparatus to the gutter.

FIGS. 12 through 17 depict various embodiments of a lock mechanism for releaseably securing the gutter protection and ladder support apparatus of the instant invention in a desired position in a gutter. For purposes of simplicity, common elements throughout the various embodiments will be designated with the same numerals.

Referring to the embodiment of FIGS. 12(*a*)-(*d*), a gutter protection and ladder support apparatus as described above in FIG. 1 is shown generally at 10 and includes a first plate member 18 structured and arranged to be releaseably positioned in a gutter and a second member 20 operatively connected to the first member and structured and arranged to support a ladder. The plate member 18 has a bracket member 74 secured to a bottom face 506 thereof and having an elongate channel 75 structured and arranged to engage a lip of a gutter (not shown). In the instant embodiment, member 20 is in the form of a generally C-shaped or L-shaped channel member 20 secured in a fixed position to member 18, for example, by forming or welding. When a ladder rail is positioned in the second member 20, the respective elements thereof cooperate with one another and with the first member 18 to prevent lateral tipping a slippage of the ladder, as described hereinabove in greater detail.

The embodiment of FIG. 12 further includes a lock mechanism shown generally at 500 which includes a spring-biased plate 502 operatively connected to first member 18 by means of L-shaped channels or brackets 504 secured to and extending generally downwardly from the bottom face 506 of member 18. The spring-bias plate is structured and arranged to be slideably moveable in the channels and is urged in a direction shown by arrow 508 substantially parallel to the direction of a longitudinal axis x-x of plate member 18 in response to pressure applied by a plurality of springs 510. Springs 510 are operatively connected to and positioned intermediate bracket member 74 and a stop member 512 on an end of plate 502.

In operation, the apparatus 10 of FIG. 12 is inserted into a gutter channel by holding plate 502 in a compressed position against springs 510 as the lip of the gutter is inserted into channel 75 of bracket 74. After positioning the apparatus at a desired angle with respect to the ground or surface upon which the ladder rests, the plate 502 is released and a distal edge 514 thereof is urged in the direction of arrow 508 into locking engagement with and against a back surface of the gutter, thereby securing the ladder in position for safe use.

Figures 13A, 13B, 13C:
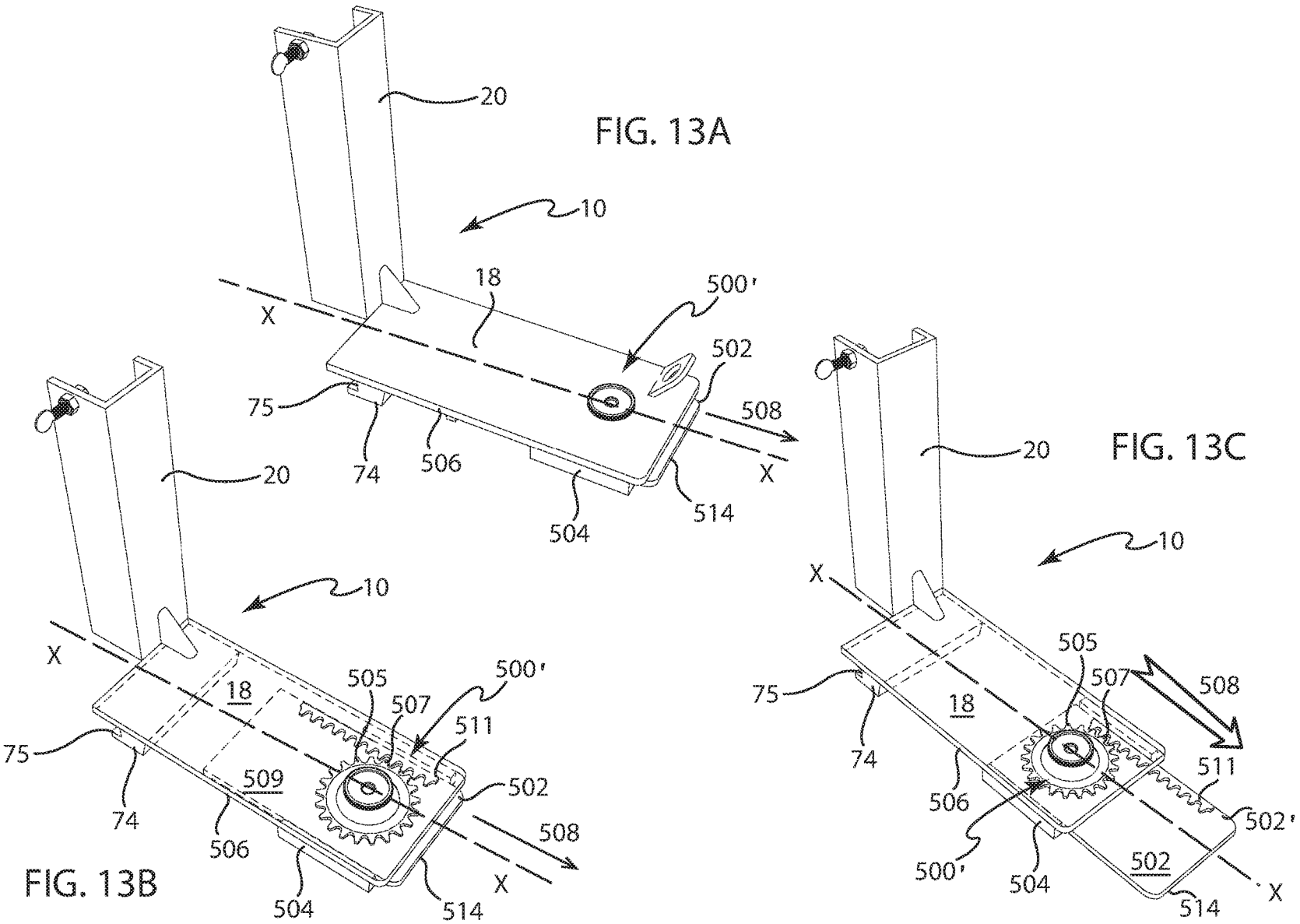
FIGS. 13(*a*)-(*c*) are side perspective views of a securing mechanism of the apparatus of the present invention in accordance with still another embodiment.

In still another embodiment as illustrated in FIGS. 13(*a*)-(*c*), the gutter protection and ladder support apparatus 10 includes a lock mechanism comprising a rack and pinion gear mechanism 500' mounted on plate member 18. As best shown in FIG. 13(*b*), the lock mechanism includes a gear 505 rotatably mounted to the bottom face 506 of member 18, the gear having a plurality of teeth 507 structured and arranged to engage a plurality of mating teeth 509 in a rack 511 secured to a top surface 502' of plate 502. An activating device, by way of example, a knurled knob 513, is mounted on plate member 18 and operatively connected to gear 505 by means of a shaft extending through an aperture formed in the plate 18. In operation, the apparatus 10 of FIG. 13 is inserted into a gutter channel with plate 502 in a retracted position as shown in FIG. 13(*a*) as the lip of the gutter is inserted into channel 75 of bracket 74. After positioning the apparatus at a desired angle with respect to the ground or surface upon which the ladder rests, knob 513 is rotated in a clockwise direction whereby edge 514 of plate 502 is urged into locking engagement with and against a back surface of the gutter, thereby securing the ladder in position for safe use.

Figure 14A:
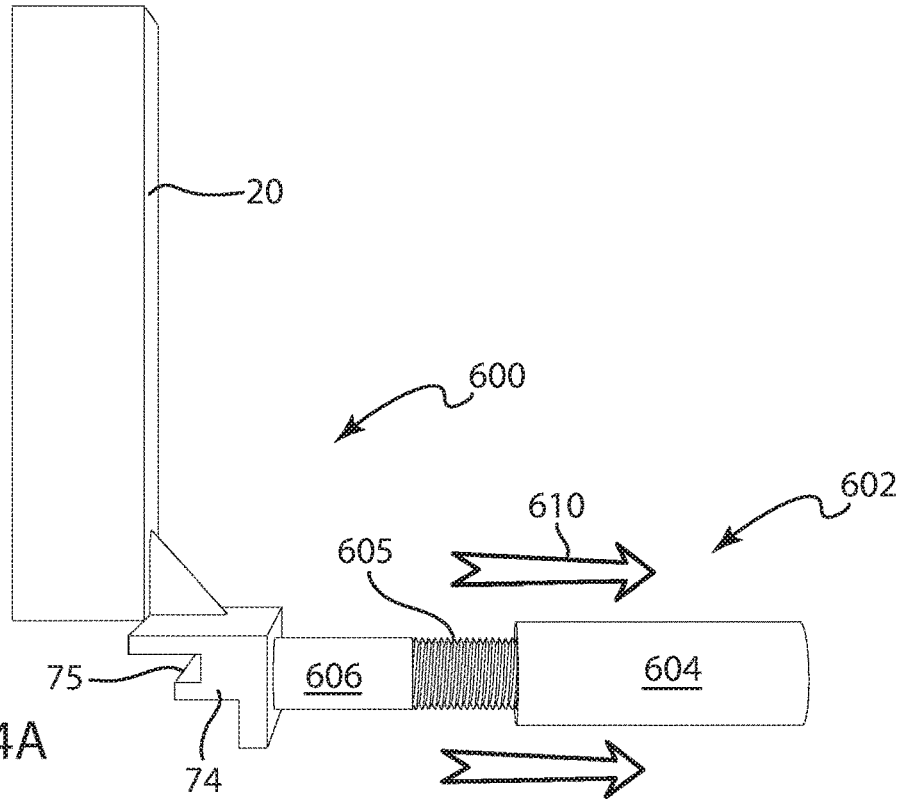
FIGS. 14(*a*)-(*b*) are side perspective views of a securing mechanism of the apparatus of the present invention in accordance with yet another embodiment FIGS. 15(*a*)-(*b*) are side perspective views of a securing mechanism of the apparatus of the present invention in accordance with an embodiment.
Figure 14B:
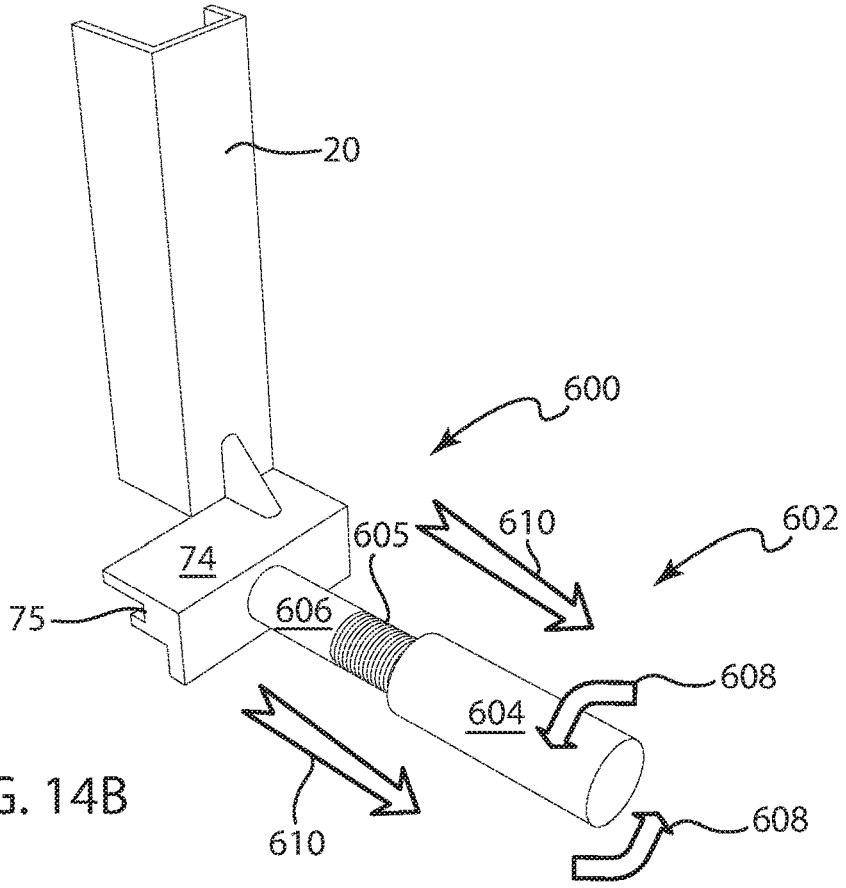

FIGS. 14(*a*) and (*b*) depict another embodiment of a gutter protection and ladder support apparatus 600 of the present invention in which a mechanism 602 for releaseably lock the apparatus in a gutter is in the form of a threaded sleeve 604 rotatably positioned over a distal end 605 threaded shaft 606 extending generally perpendicularly outwardly away from bracket 74. In operation, after the lip of a gutter is inserted in channel 75 of bracket 74, as hereinabove described with respect to other embodiments, sleeve 604 may be positioned in a gutter channel and rotated counterclockwise in the direction of arrows 608 shown in FIG. 14(*b*). In response to this rotation, the sleeve moves along the threaded distal end 605 of shaft 606 in the direction of arrow 610 (FIG. 14(*a*)) into releasable locking engagement with a back surface of a gutter (not shown) for securing the apparatus 600 in place during use.

Figure 15A:
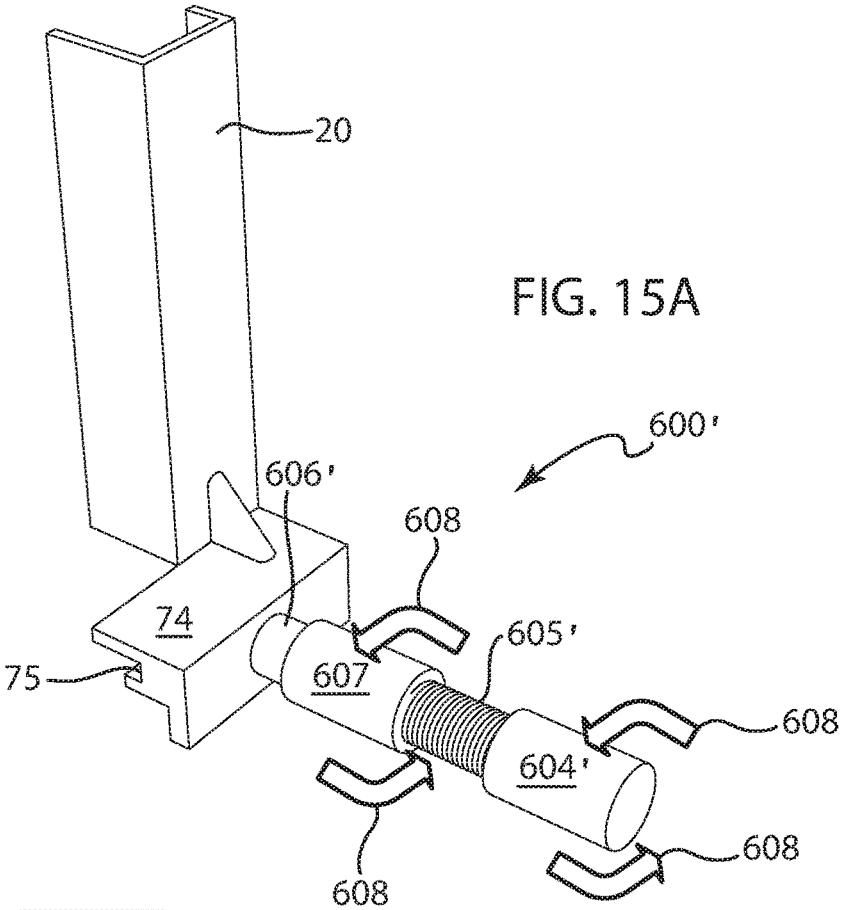
Figure 15B:
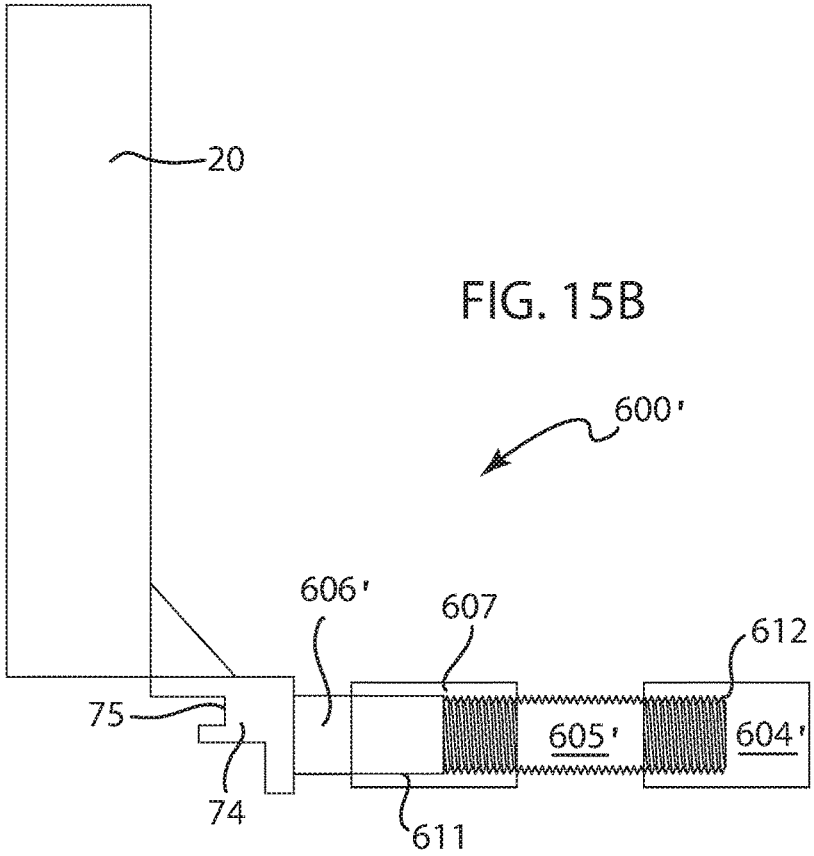

In a variation of the embodiment of FIG. 14 shown in FIGS. 15(*a*) and (*b*), a sleeve 607 having threads extending only along the length of a distal end 609 thereof is mounted, by way of example, by press fitting an unthreaded portion 611 thereof over an unthreaded shaft 606'. Shaft 605' is rotatably inserted into the end 609 of sleeve 607, and sleeve 604' is rotatably inserted over a threaded distal end 612 thereof. In operation, similar to the operation of the embodiment of FIG. 14, both the threaded shaft 605' and the sleeve 604' may be selectively rotated in the direction of arrows 608 to adjust the position of the apparatus 600' in a gutter prior to releaseably securing it in place during use.

Figure 16A:
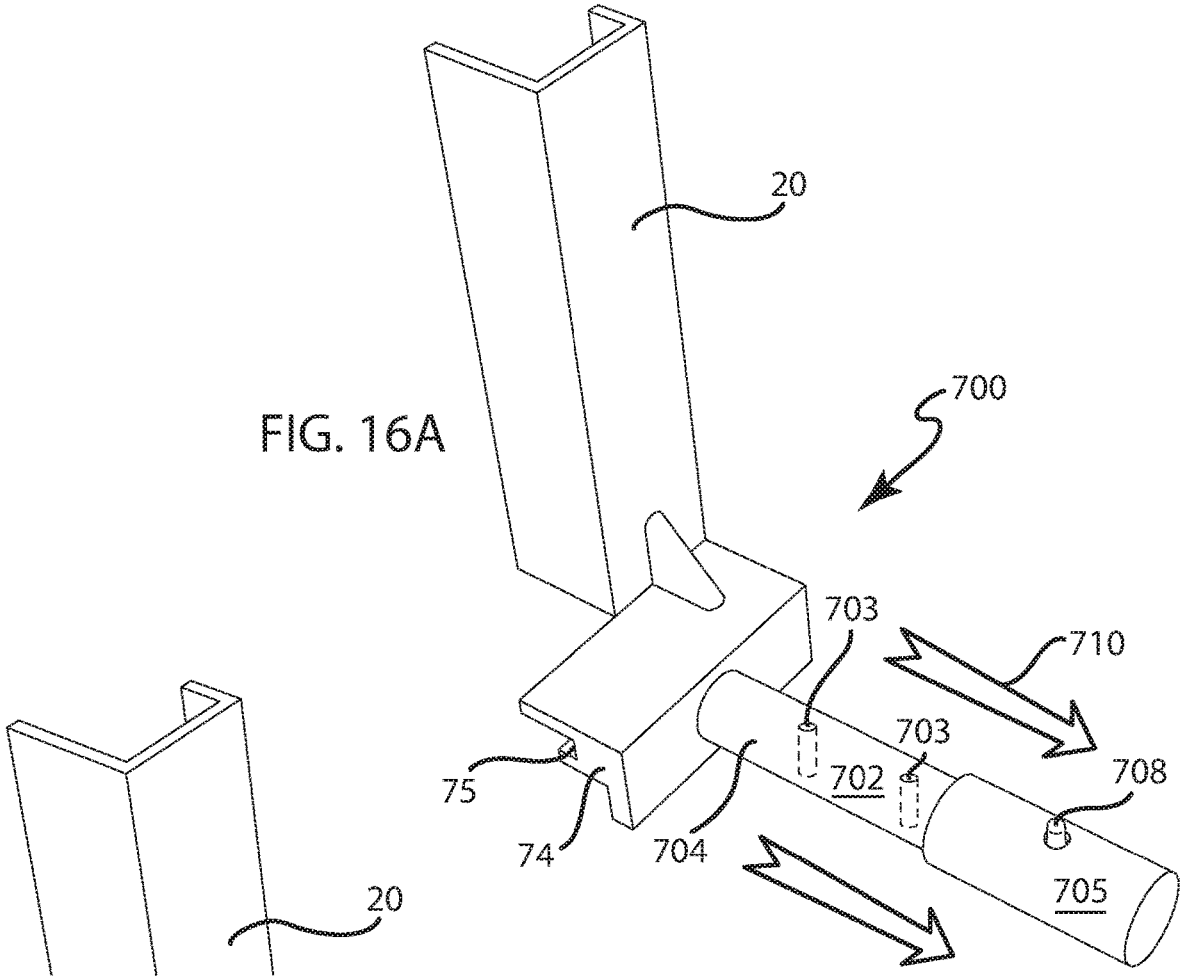
FIGS. 16(*a*)-(*b*) are side perspective views of a securing mechanism of the apparatus of the present invention in accordance with another embodiment.
Figure 16B:
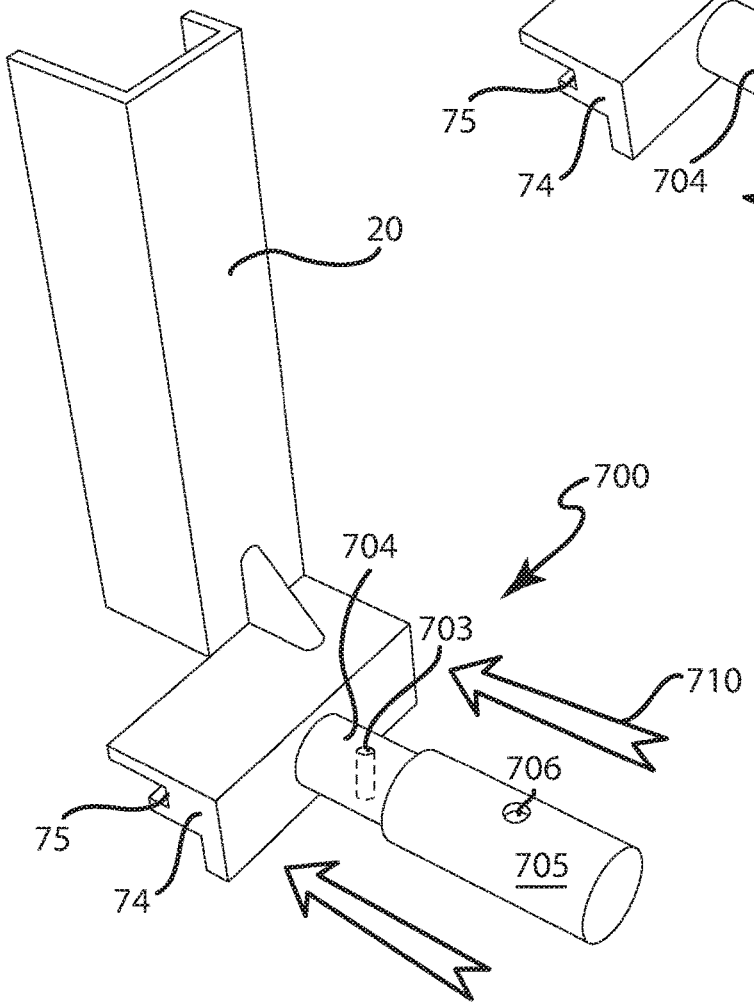

Referring now to FIGS. 16(*a*) and (*b*), an embodiment 700 of the gutter protection and ladder support apparatus of the present invention is shown. In this embodiment, a shaft 702 having a plurality of generally evenly spaced-apart, radially transversely extending apertures or indentations 703 formed therein is secured at a proximal end 704 to bracket 74 and extends generally perpendicularly outwardly therefrom. A sleeve 705 is slideably positioned over a distal end (not shown) of shaft 702 and is slideably moveable along the shaft 702 in the directions indicated by arrows 710. An aperture 706 is formed in shaft 705 and is structured and arranged to receive a fastener 708, which, by way of example and not of limitation, may be in the form of a cottar pin or a rod, which passes therethrough and into one of the plurality of apertures or indentations 703 formed in shaft 702. As described above with respect to earlier embodiments, once the apparatus 700 is selectively positioned in a gutter, sleeve 705 is moved into operative engagement with a back surface thereof, and fastener 708 is inserted into aperture 706 and one of the plurality of apertures 703 to secure the apparatus in place during use.

Figure 17B:
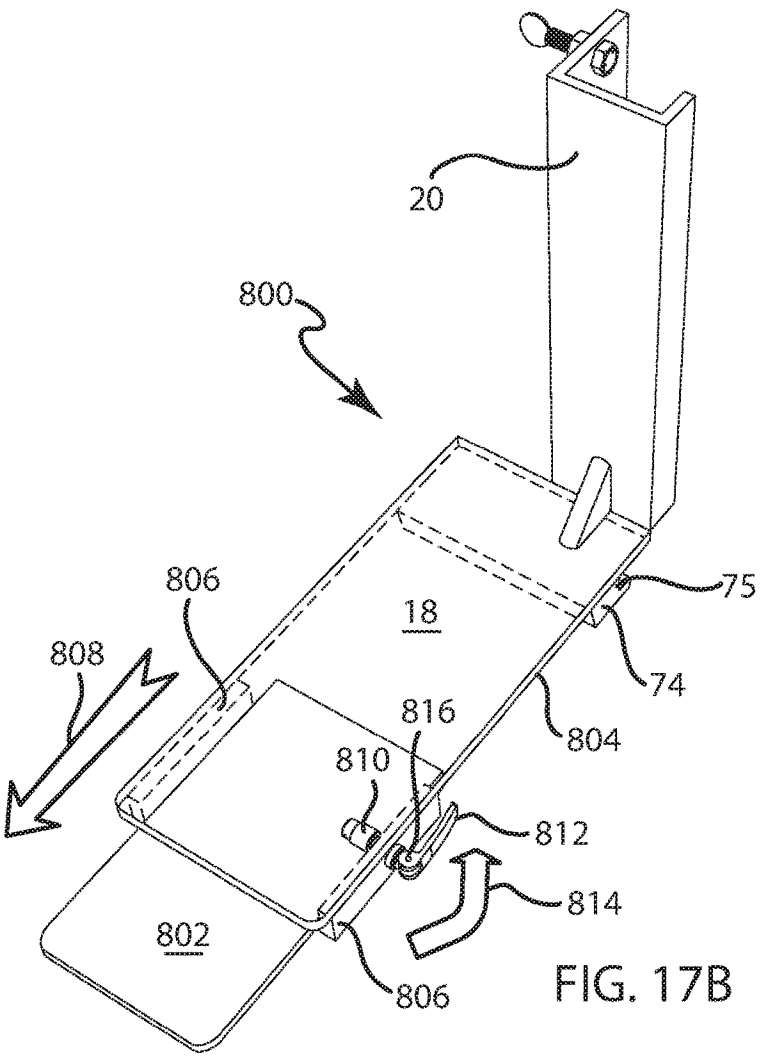
FIGS. 17(*a*)-(*b*) are side perspective views of a securing mechanism of the apparatus of the present invention in accordance with yet another embodiment.
Figure 17A:
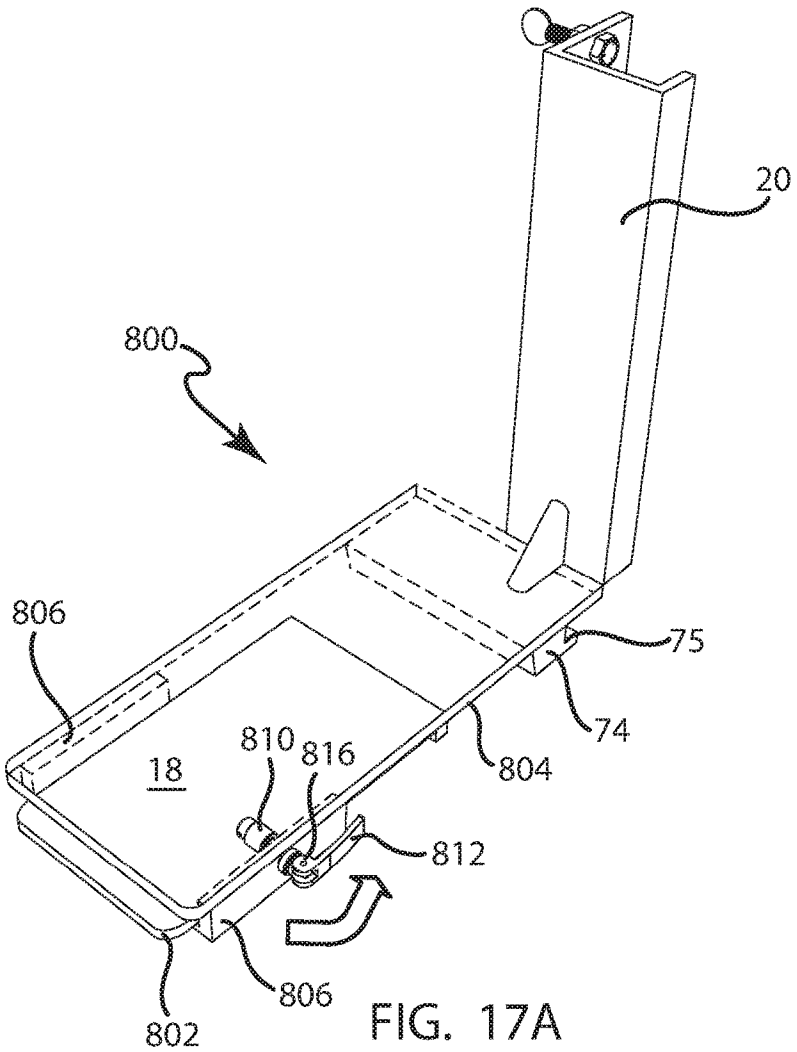

FIGS. 17(*a*) and (*b*) illustrate another embodiment 800 of the gutter protection and ladder securing apparatus of the present invention in which the mechanism for releaseably locking the apparatus in a gutter is in the form of a plate member 802 slideably mounted on a bottom face 804 of plate 18 by a pair of L-shaped brackets or channel members 806 extending from the face. In operation, plate 802 may be moved in the direction of arrow 808 (FIG. 17(*b*)) into operative locking engagement with a back surface of a gutter, as hereinabove described, and then releaseably locked into position by a movable clamp member 810 which is actuated by moving operating handle 812 in the direction of arrow 814. The plate 802 is retained in a preselected position during use of apparatus 800 by cam member 816, which may then be released to remove the apparatus from the gutter.

Figure 18B:
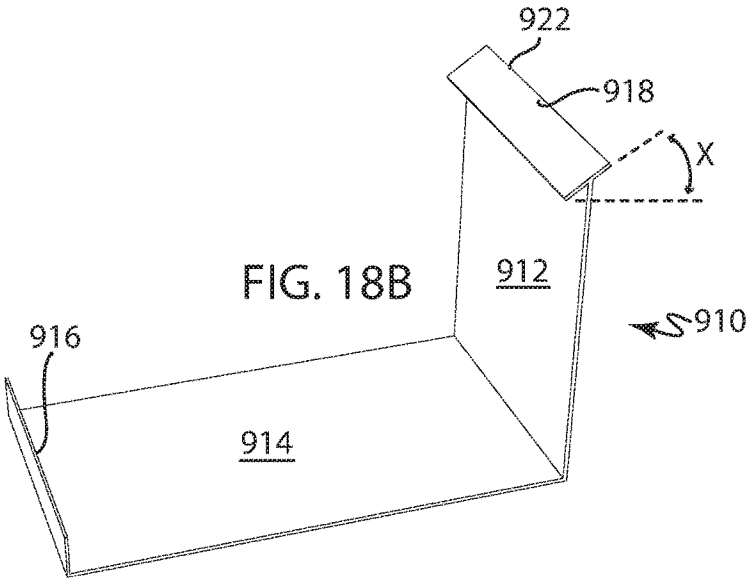
FIGS. 18(*a*)-(*c*) are side perspective views of the gutter protection and ladder support apparatus according to another embodiment of the present invention.
Figure 18A:
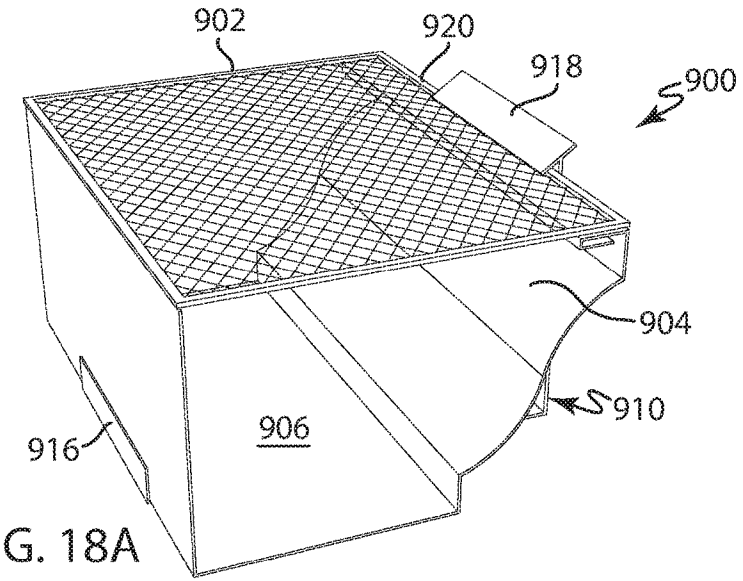
Figure 18C:
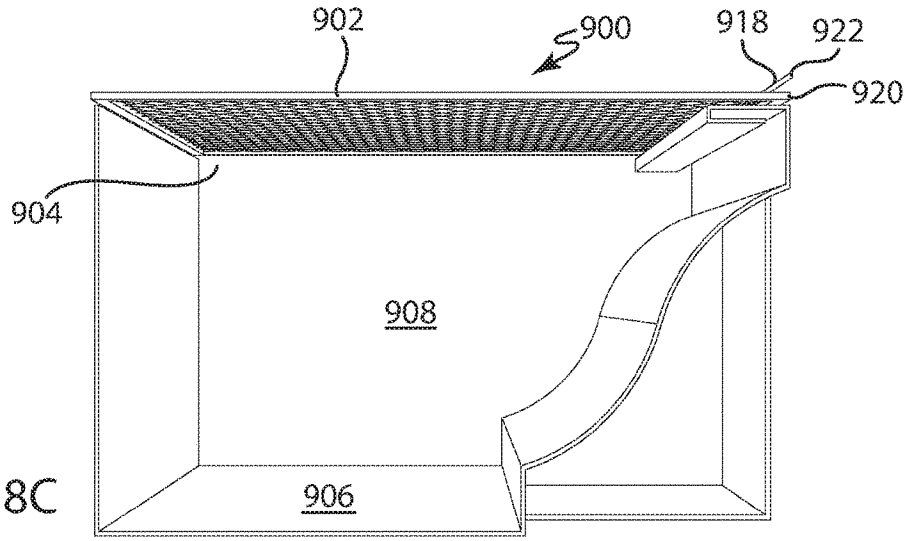

Another embodiment of the gutter protection and ladder securing apparatus of the present invention is shown generally by the numeral 900 in FIGS. 18(*a*)-(*c*). Apparatus 900 includes a screen member 902 which is adapted to fit over an open top 904 of a gutter 906 and is designed to prevent material from falling into the gutter channel shown generally at 908 in FIG. 18(*c*). Referring to FIG. 18(*b*), the apparatus 900 further includes an L-shaped bracket 910 having a first member 912 and a second member 914 secured thereto and extending substantially orthogonally therefrom. A lip 916 is attached to or formed on an end of member 914 and is structured and arranged to be positioned intermediate the gutter 906 and a supporting fascia board (not shown) as the apparatus is positioned on the gutter. A generally rectangular shaped plate member 918 is secured to an end of member 912 as shown in FIG. 18(*b*) at an angle $\alpha$ thereto, the angle $\alpha$ being in a range of approximately 30 to approximately 60 degrees, and is adapted to fit over an edge 920 of screen member 902 after it is installed on the gutter 906. A ladder (not shown) may then be positioned against edge 922 of plate 918, the entire assembly being designed to protect the gutter from damage caused by positioning and using the ladder leaning against the apparatus.

Figure 19A:
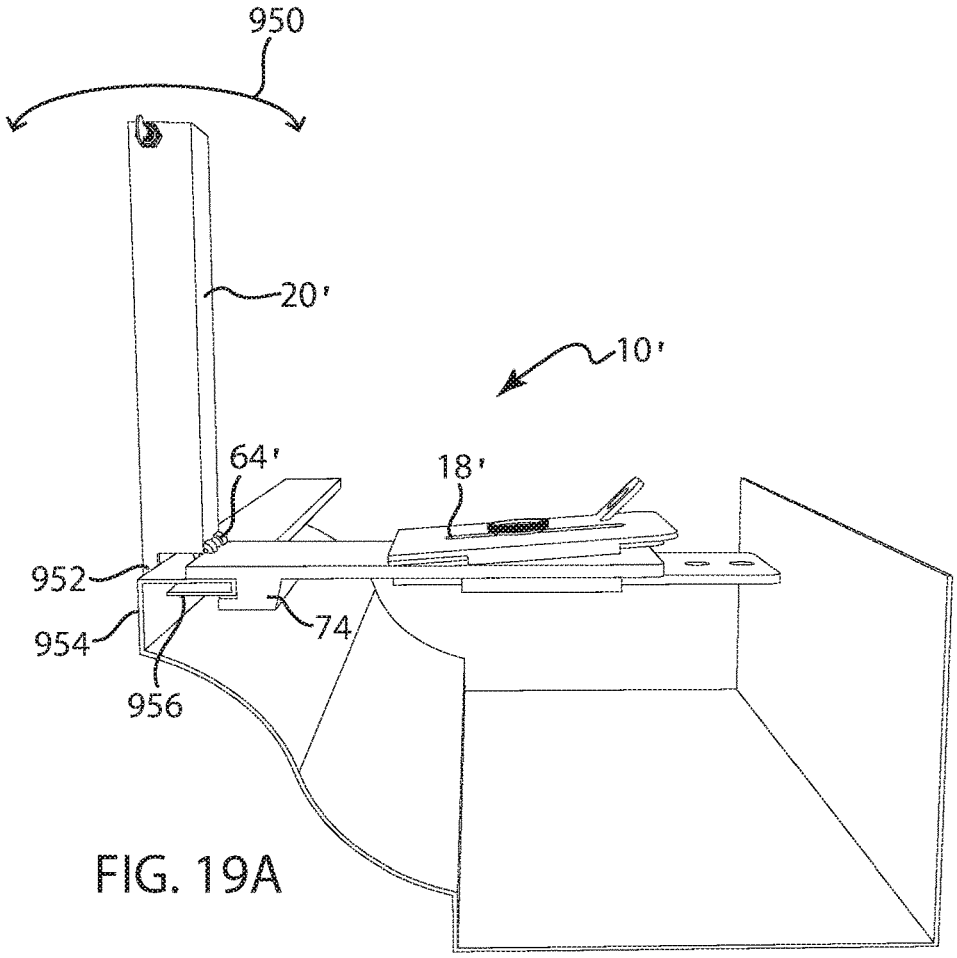
FIGS. 19(*a*)-(*b*) are side perspective views of the gutter protection and ladder support apparatus according to still another embodiment of the present invention.
Figure 19B:
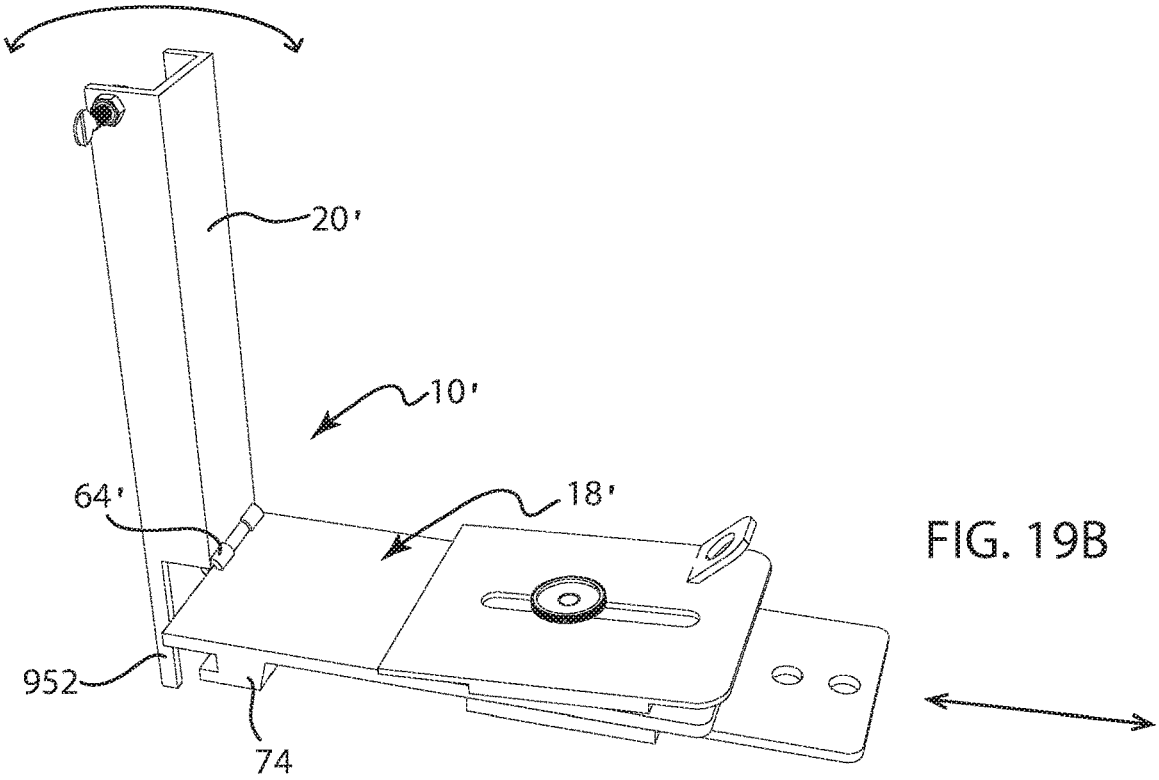

FIGS. 19(*a*) and (*b*) depict yet another embodiment 10' of the embodiment of apparatus 10 shown in FIGS. 2(*a*)-(*c*). In this embodiment, a first member 18' and a second member 20' are pivotally connected by hinge 64', whereby member 20' may be folded in the direction of arrows 950 to rest upon member 18' for shipping and transportation purposes. In use, following installation of the apparatus in a gutter as described in greater detail above, member 20' may be moved to an upright position and secured in place by a stop member 952 which abuts a face 954 of the gutter and cooperates with channel 75 formed in bracket 74 to receive the gutter lip 956 in securing the apparatus thereto.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A gutter protection and ladder support apparatus for engagement with a gutter, the gutter including an interior side wall portion positioned adjacent a fascia board of a building structure, an exterior side wall portion positioned in opposed spaced apart relationship to the interior side wall portion, and a lip portion associated with the exterior side wall portion, said apparatus comprising:

a first member having a longitudinal axis and first and second opposed end portions positioned at opposing distal ends of the first member along the longitudinal axis and being structured and arranged to be releaseably positioned in the gutter, the first end portion of said first member including a lip engaging bracket member having an elongated channel open in a direction away from the second opposed end portion and generally parallel to the longitudinal axis of said first member and structured to receive the lip portion of the exterior side wall portion of the gutter within said elongated channel, the second end portion of said first member including a mechanism for releasably wedging the second end portion of said first member against the interior side wall portion of the gutter;

a second member operatively connected to the first member, the second member being structured and arranged to support a ladder; and a ladder securing apparatus connected to the second member and configured to secure a ladder thereto, the ladder securing apparatus being adjustable for selective fastening the ladder to the second member;

wherein the mechanism for wedging the second end portion of the first member against the interior side wall portion of the gutter includes a threaded shaft having a threaded sleeve disposed thereon, the threaded sleeve being adjustably movable along the shaft to releasably wedge the second end portion of said first member against the interior side wall portion of the gutter.

2. The gutter protection and ladder support apparatus of claim 1 wherein the mechanism for wedging the second end portion of said first member against the interior side wall portion of the gutter includes an adjustable mechanism.

3. The gutter protection and ladder support apparatus of claim 1 wherein the ladder securing apparatus comprises a threaded fastener extending through a portion of the second member and being adapted to engage a portion of the ladder.

4. The gutter protection and ladder support apparatus of claim 1 wherein the ladder securing apparatus includes an adjustable channel member secured to the second member, the channel member being structured and arranged to engage a portion of the ladder.

5. The gutter protection and ladder support apparatus of claim 1 wherein the ladder securing apparatus includes a Velcro strap secured to the second member and adapted to be releasably secured to a portion of the ladder.

6. The gutter protection and ladder support apparatus of claim 1 wherein the ladder securing apparatus comprises a banding strap secured to the second member and adapted to be releasably secured to a portion of the ladder.

* * * * *